US008662695B2

(12) United States Patent
Wilson

(10) Patent No.: US 8,662,695 B2
(45) Date of Patent: Mar. 4, 2014

(54) MODULAR ELECTRICAL DISTRIBUTION SYSTEM FOR A BUILDING

(75) Inventor: Harold R. Wilson, Holland, MI (US)

(73) Assignee: Haworth, Inc., Holland, MI (US)

( * ) Notice: Subject to any disclaimer, the term of this patent is extended or adjusted under 35 U.S.C. 154(b) by 244 days.

(21) Appl. No.: 13/351,504

(22) Filed: Jan. 17, 2012

(65) Prior Publication Data

US 2013/0182416 A1 Jul. 18, 2013

(51) Int. Cl.
*F21S 8/04* (2006.01)

(52) U.S. Cl.
USPC ..... 362/147; 362/221; 362/260; 439/215

(58) Field of Classification Search
USPC ..... 362/147, 148, 221, 222, 260, 217.01, 362/217.1, 253, 234; 439/215, 677, 345
See application file for complete search history.

(56) References Cited

U.S. PATENT DOCUMENTS 5,580,158 A * 12/1996 Aubrey et al. ..... 362/260
6,488,386 B1 * 12/2002 Yan ..... 362/260
7,438,433 B1 * 10/2008 Steadman et al. ..... 362/147
7,648,379 B2 * 1/2010 Johnson et al. ..... 439/215
7,697,268 B2 * 4/2010 Johnson et al. ..... 361/643
7,826,202 B2 * 11/2010 Johnson et al. ..... 361/641
7,841,878 B2 * 11/2010 Johnson et al. ..... 439/215
8,104,928 B1 * 1/2012 Horn ..... 362/287
8,172,588 B2 * 5/2012 Johnson et al. ..... 439/215
2002/0136001 A1 * 9/2002 Lefkovitz et al. ..... 362/147
2010/0328852 A1 12/2010 Johnson et al.
2010/0328853 A1 12/2010 Johnson et al.

* cited by examiner

*Primary Examiner* — Bao Q Truong
(74) *Attorney, Agent, or Firm* — Warner Norcross & Judd LLP

(57) ABSTRACT

An adapter structure which cooperates between a modular electrical distribution unit and a light fixture to facilitate electrical connection therebetween. The adapter structure includes an adapter module having an insulative housing containing electrical conductors extending therethrough and defining connectors at input and output ends thereof. The housing mounts directly to the light fixture, preferably within and extending through a knock-out port in a wall of the light fixture, and a plug-type connector at the output end of the adapter structure can be plug engaged with a compatible connector associated with a electrical power distribution unit. The output end of the adapter has a gripping conductive socket structure which enables pigtail conductors associated with the light fixture to be directly plugged therein.

13 Claims, 37 Drawing Sheets

MODULAR ELECTRICAL DISTRIBUTION SYSTEM FOR A BUILDING

CROSS REFERENCE TO RELATED APPLICATIONS

This application is related to application Ser. Nos. 12/798,746 and 12/798,747, both filed Apr. 9, 2010, and both titled "Modular Electrical Distribution System for a Building".

FIELD OF THE INVENTION

This invention relates to a modular electrical distribution system for a building, primarily a non-residential building, and specifically relates to a modular light fixture adapter which couples between the electrical distribution system and the light fixture to facilitate mechanical and electrical connection of the distribution system to the light fixture.

BACKGROUND OF THE INVENTION

Providing electrical power to a building, specifically a non-residential building such as a box store, involves installation of numerous long runs of electrical conduit which must be electrically connected to numerous and various electrical components such as receptacles, switches, lights and numerous other electrical devices and equipment. Such complex electrical system necessarily involves a complex and extremely time consuming installation. In an effort to simplify the installation of such complex system and at the same time improve the selectability and flexibility of the system, the Assignee hereof developed the modular electrical distribution system disclosed in the aforementioned co-pending application Ser. Nos. 12/798,746 and 12/798,747, the disclosures of which are incorporated herein by reference, and which is also disclosed in U.S. Pat. Nos. 7,648,379, 7,697,268, 7,826,202 and 7,841,878, all owned by the Assignee hereof. In this aforementioned electrical distribution system, numerous components or modules are provided so as to simplify installation of the electrical system within a building, particularly a non residential building such as a box store, while at the same time providing optimum flexibility and selectability with respect to the design of the electrical system and a greater ease of installation thereof into the building. While the modular electrical distribution system mentioned above provides significant advantages relative to a conventional system (often referred to as a hard-wired system), particularly with respect to installation and subsequent modification, nevertheless this modular electrical distribution system has not satisfactorily addressed connection of the modular system to light fixtures within the building, specifically a network of ceiling light fixtures such as fluorescent fixtures as conventionally used in non-residential buildings.

More specifically, non-residential buildings conventionally use ceiling light fixtures, and frequently mount them suspended downwardly from the ceiling, such as by the grid work associated with a dropped ceiling arrangement. The light fixtures, such as conventional fluorescent tube light fixtures, typically have a wiring pigtail, conventionally three solid electrical conductors, for connection to an electrical supply conduit which is typically fed from above through a knockout port provided in a top wall of the fixture, with solid wire conductors associated with a supply pigtail being electrically joined to the conductors which define the pigtail of the fixture. The conductors defining the fixture pigtail are typically joined through an intermediate connector, to the pigtail conductors on the supply conduit. To facilitate installation and electrical connection, which is normally preferably carried out from above the light fixture, the top wall of the light fixture housing is typically provided with a removable cover plate sized to permit an installer to have access therethrough. This cover plate is also typically provided with a knockout port associated therewith to facilitate feeding of the electrical supply conduit therethrough to assist with respect to the overall installation and electrical connection. In some situations, however, the supply conduit may be fed through a knockout port disposed at some other location on the light fixture housing. These knockout ports are generally of conventional size, typically $7/8^{th}$ inch diameter. In this conventional arrangement, a separate intermediate connector is required for joining the pigtail conductors of the light fixture to the pigtail conductors of the supply conduit which is associated with the modular power system disposed above the light fixture.

Accordingly, it is an object of this invention to provide an improved adapter structure which cooperates between the modular electrical distribution system and the light fixture to facilitate initial installation and electrical connection of the modular distribution system to the light fixture by facilitating access to the light fixture from both above or below, and also facilitating access to the fixture for performing maintenance thereon, such as when replacement of a ballast is required.

In accordance with the present invention, there is provided a light fixture adapter module which includes an insulative housing containing therein a family of electrical conductors, typically five such conductors capable of defining a three-circuit arrangement. The housing and the conductors at one end of the module, typically an upper end, define a plug-like connector which is compatible and engageable with a plug-like connector provided on one end of a flexible conduit unit associated with the modular power distribution assembly to facilitate electrical connection to the light fixture adapter module. The adapter module housing can be mounted to the housing of the light fixture, preferably from above, by pressing the adapter housing downwardly through a knockout port to effect a snap fit engagement with the light fixture. The other end of the adapter module, which accesses the interior of the light fixture housing, defines a plurality of ports which function as a plug-in socket to permit the individual pigtail conductors of the light fixture to be slidably inserted therein for mechanical and electrical engagement with the conductors of the adapter. The pigtail conductors can be engaged with the adapter prior to the adapter being fitted to the housing.

Other objects and advantages of the present invention will be apparent to persons familiar with the environment of this invention upon reading the following specification and inspecting the accompanying drawings.

Figure 1:
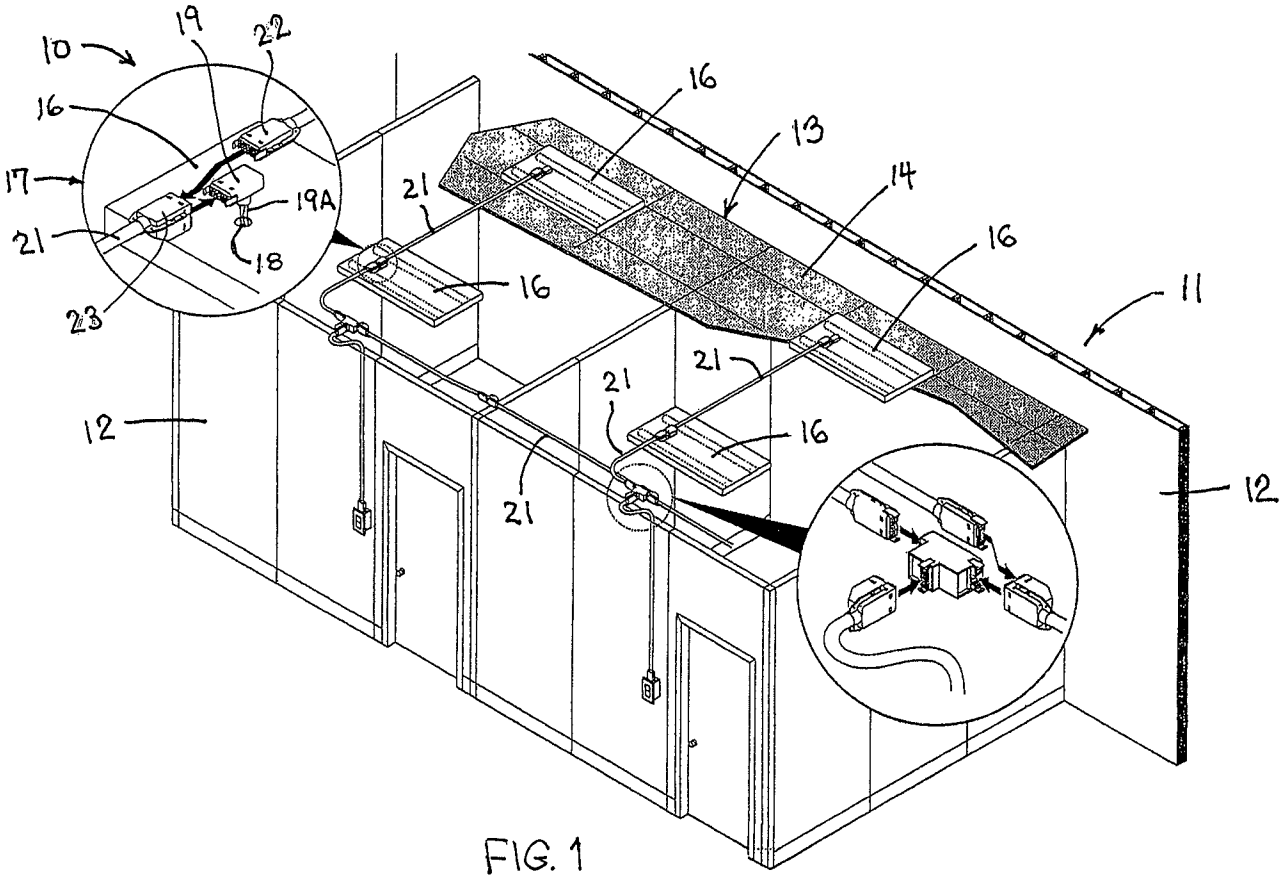
FIG. 1 is a pictorial view of a building structure having a modular power distribution system installed therein and specifically defining a lighting configuration.

Certain terminology will be used in the following description for convenience and reference only, and will not be limiting. For example, the words "upwardly", "downwardly", "rightwardly" and "leftwardly" will refer to directions in the drawings to which reference is made. The words "upwardly" and "downwardly" will also be used in reference to the normal orientations experienced with respect to the lighting fixture, and the adapter mounted thereon, during normal use conditions. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to FIG. 1, there is illustrated an exemplary building structure 11 having a universal power distribution system 10 associated therewith so as to supply electrical power to numerous electrical devices associated with the building. In this regard, the power distribution system 10 includes, as a principal building block of the system, an elongate flexible conductor unit 21 which can extend along or through the walls (both external and internal) and along the floor, if necessary, to supply electrical power to various conventional electrical devices such as switches, receptacles and the like.

This power distribution system 10 also supplies electrical power to a ceiling 13 which, in the illustrated arrangement, is a conventional drop ceiling as is typically defined by ceiling panels 14 supported on a suspended grid arrangement, thereby defining an overhead clearance space between the roof or structure defined thereabove. The ceiling, as is generally conventional, may be provided with a plurality of light fixtures 16 supported thereon, typically fluorescent-tube type fixtures. The power distribution system 10 is arranged to supply electrical power to a plurality of the lighting fixtures 16 and, as illustrated by the area designated by reference numeral 17, the light fixture 16 includes a knockout port or hole 18 associated with the top wall of the light fixture housing. This knockout port 18 cooperates with a fixture tap or module 19 which has a protruding pigtail connector 19A typically defined by three conductive members which are provided for electrical connection to corresponding conductive pigtail members which protrude from the ballast of the light fixture. The fixture tap 19 in turn plugs into an elongate flexible conductor unit 21 which serves as the primary wiring unit for supplying electrical power to the light fixture. The conductor unit 21 may connect to an additional downstream conductor unit 21 for supplying power to an additional light fixture 16, thereby permitting ganging of the light fixtures. A plurality of such conductor units 21 are engageable one with another and are routed throughout the building cavities to supply power from a first upstream conduit unit which connects to a suitable power supply.

Figure 2:
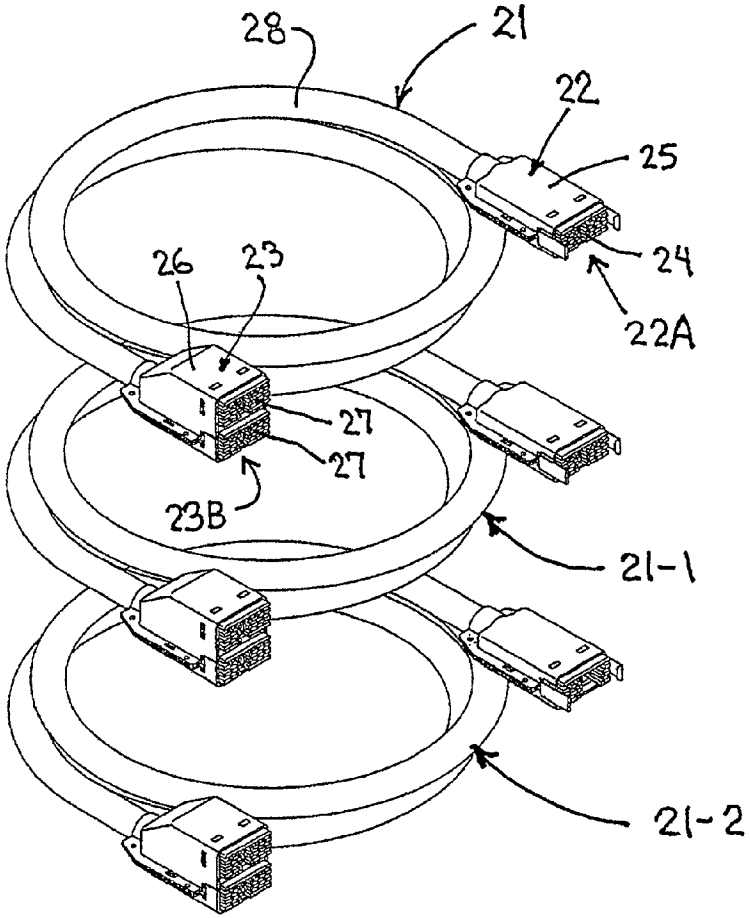
FIG. 2 diagrammatically illustrates several embodiments of flexible conductor units associated with the modular electrical distribution system for defining flexible conduit runs through building cavities.
Figure 2:
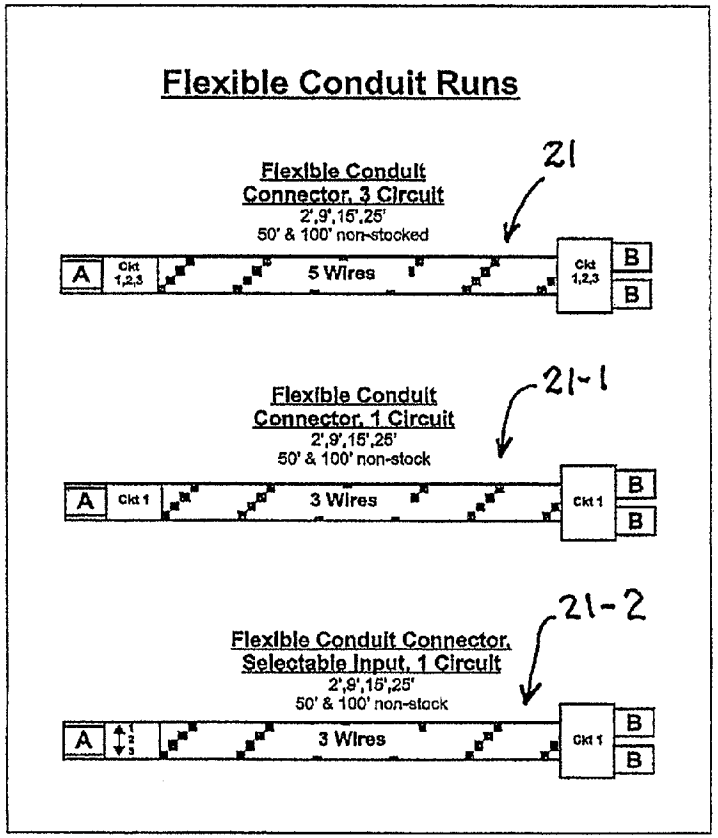

The elongate flexible conductor unit 21, as illustrated in greater detail in FIG. 2, includes an upstream single end connector 22 at one end thereof and, in the illustrated embodiment, includes a downstream double end connector 23 at the other end thereof. The upstream single end connector 22 defines, at the exposed end thereof, an electrically conductive contact block arrangement 24 which is mounted within the surrounding outer housing 25. In similar fashion the downstream double end connector 23 has an outer housing 26 which mounts therein a pair of electrically conductive contact block arrangements 27. The contact block arrangements 24 and 27 associated with the end connectors 22 and 23 are in turn electrically joined to a family of elongate electrical conductors which extend therebetween and are positioned within the elongate flexible connector 28, the latter typically including an outer flexible metal sheath. The upstream single end connector 22 defines a plug-type electrical connector 22A, and the downstream double end connector 23 defines a pair of plug-type electrical connectors 23B. The electrical connectors 22A and 23B as defined on opposite ends of the flexible conductor unit 21 are configured, principally by means of keying structure associated with the housings, so that opposite ends of the conductor unit 21 are handed, with the electrical connector 22A being referred to as an "A" configuration, and the electrical connector 23B having a different configuration referred to as a "B" configuration. The A and B connectors can hence be disposed in plugged engagement with one another, that is, the downstream end connector 23B on one conductor unit 21 can be plug engaged with the upstream connector 22A of an adjacent conductor unit 21. However, two A type connectors cannot be directly engaged together, nor can two B type connectors be directly engaged together.

The elongate conductor unit 21 as illustrated by FIG. 2 can be provided in a variety of different lengths, and typically includes five electrical conductors extending therethrough, thereby defining three live conductors, as well as a neutral and a ground. However, as illustrated in FIG. 2, variations in this regard as it relates to the overall power distribution assembly are possible, and for example the modified flexible conductor unit 21-1 is provided with only three conductors extending therethrough and hence is a single circuit system, and the modified conductor unit 21-2 has only three conductors extending therethrough defining a single circuit but the upstream end connector has switching capability to initially receive up to three circuits but permits selection of only a single circuit passing downstream thereof. A five conductor system, however, as illustrated by the conductor unit 21, is generally preferred particularly for non-residential applications.

The modular power distribution system 10 and specifically the conductor unit 21 and the end connectors 22, 23 thereof are illustrated and described in detail in the four patents identified above, whereby further description thereof is believed unnecessary herein.

Figure 3:
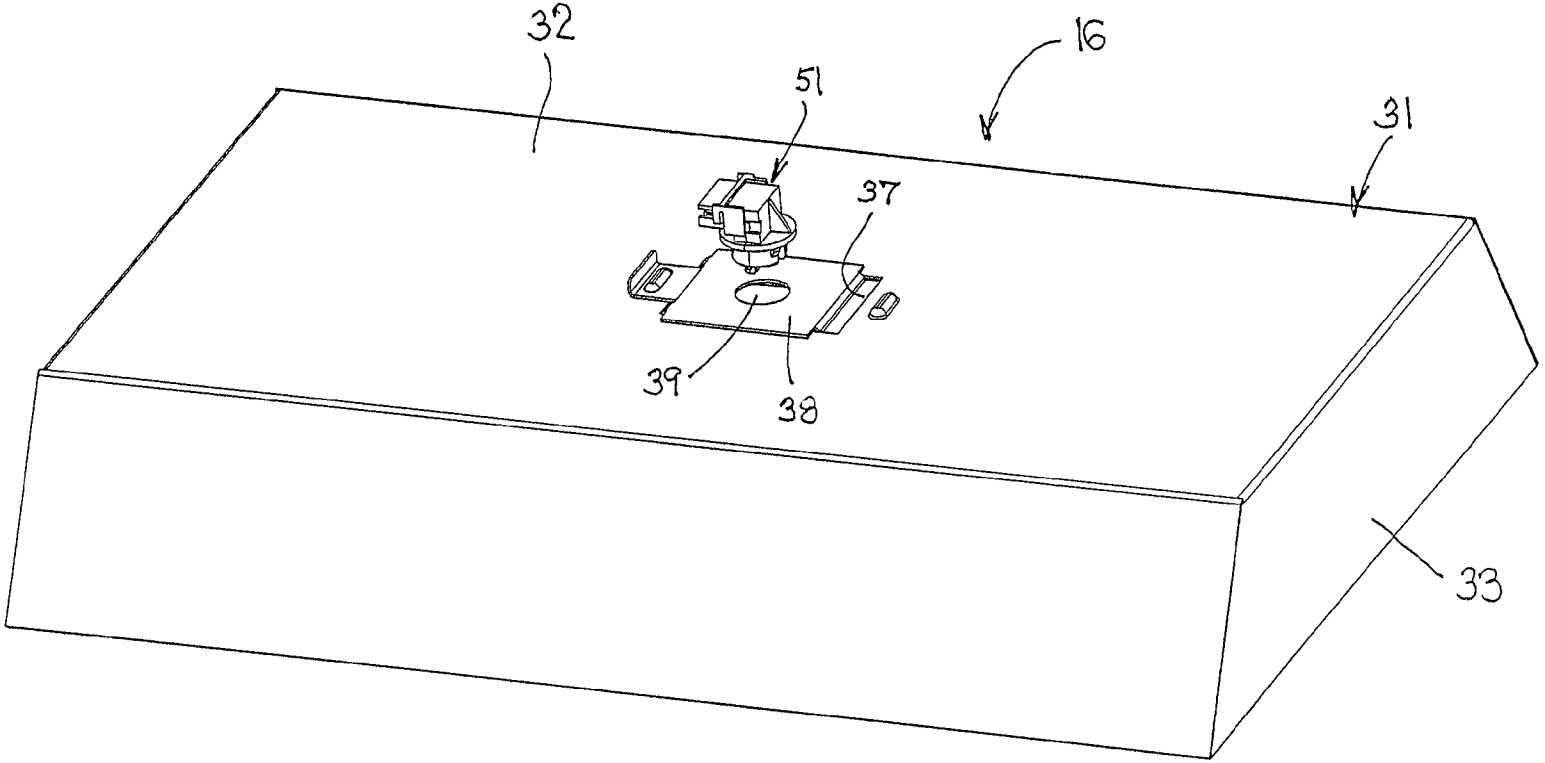
FIG. 3 is a perspective view, taken from above, of a conventional fluorescent-type ceiling light fixture, and illustrating a first embodiment of an adapter of the present invention positioned for insertion into a knockout port formed in the light fixture housing.
Figure 4:
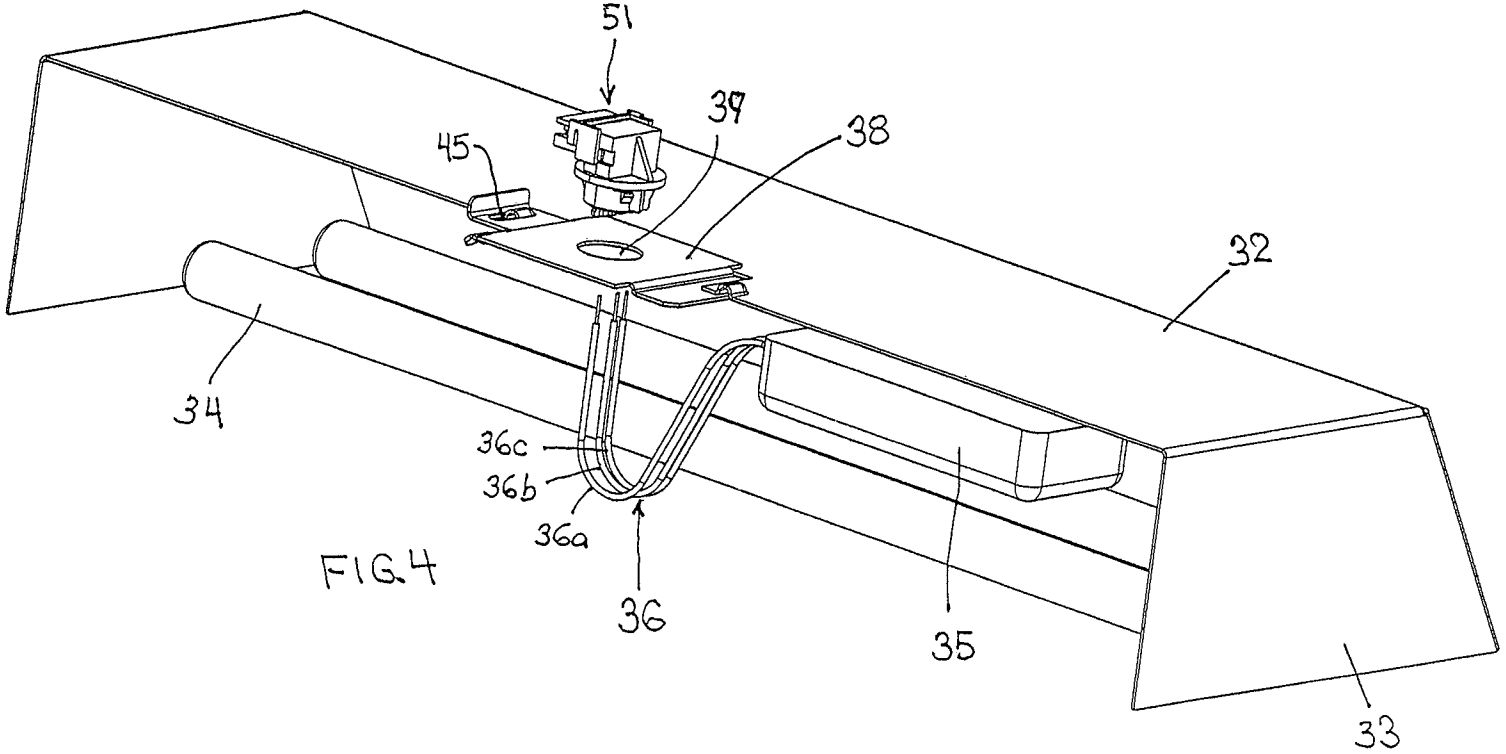
FIG. 4 is a perspective sectional view with a front half of the light fixture removed so as to illustrate the interior chamber thereof.

Considering now the construction of a typical light fixture 16 and referred specifically to FIGS. 3 and 4, the light fixture includes a housing 31 having a top wall 32 joined to a side wall construction 33 which extends therearound and protrudes downwardly so that the housing defines an interior compartment which opens downwardly. This compartment, adjacent a lower edge of the side wall construction 33, is typically covered by a removable defuser or screen for permitting transmission of light therethrough. The defuser or screen is conventional, and is not shown for clarification in illustration.

The light fixture 16, as illustrated in FIG. 4, is typically provided with two or more elongate fluorescent light bulbs 34 which are supported within the compartment on conventional end connectors which in turn are electrically coupled to a ballast 35. This ballast 35 is typically secured to the underside of the top wall 32. The ballast in turn is typically provided with a flexible pigtail connector arrangement 36 projecting outwardly therefrom, the latter typically being defined by three conductors which are illustrated at 36*a*, 36*b* and 36*c*, which three conductors define the usual live, neutral and ground. The pigtail conductors 36, at their free ends, are typically provided with a length of exposed solid wire conductor protruding outwardly beyond the insulative covering so as to facilitate electrical connection of the light fixture to an electrical source.

Figure 5:
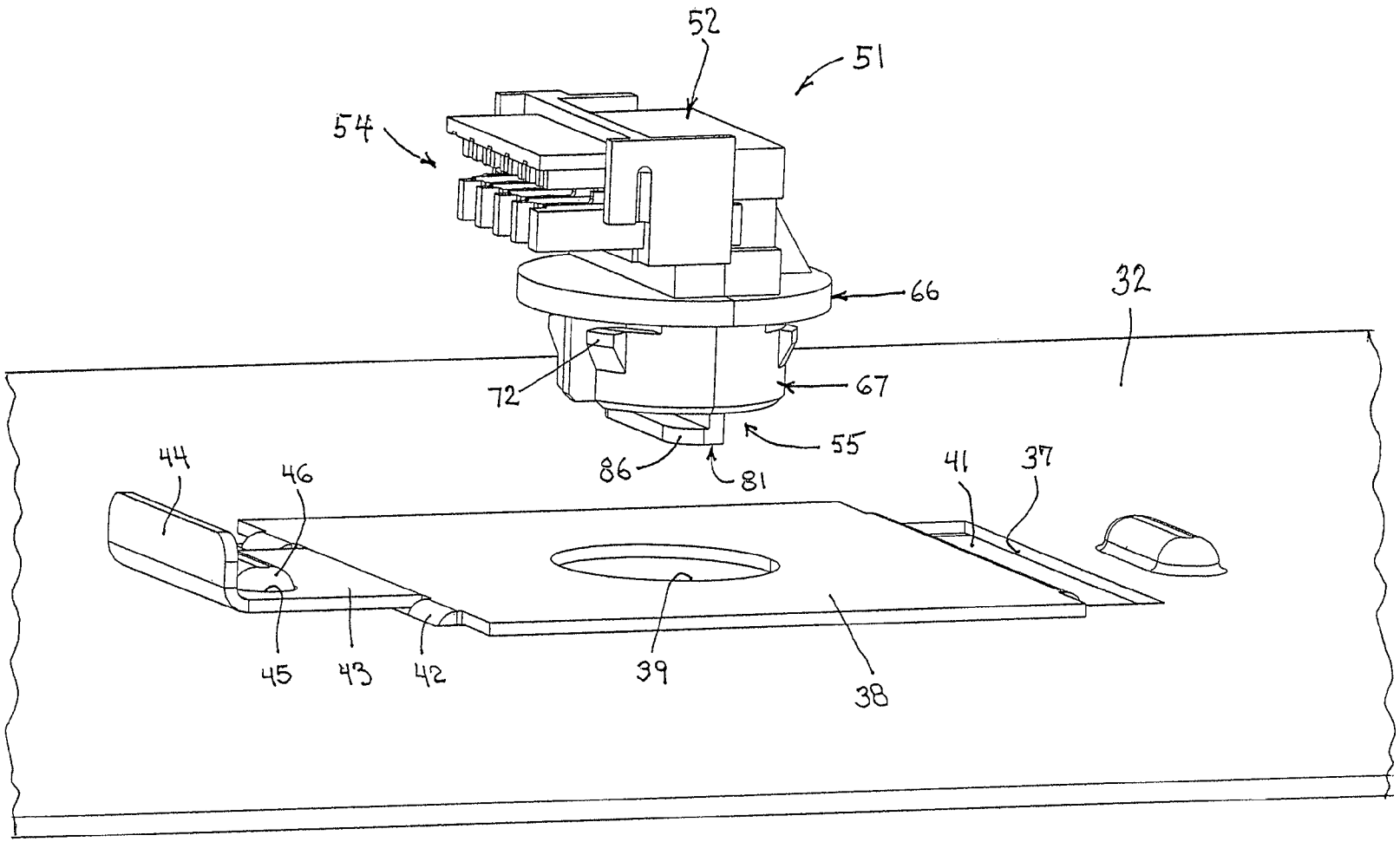
FIG. 5 is an enlarged perspective view illustrating a removable cover plate associated with the top wall of the fixture housing, and a light fixture adapter module positioned above the knockout port.
Figure 6:
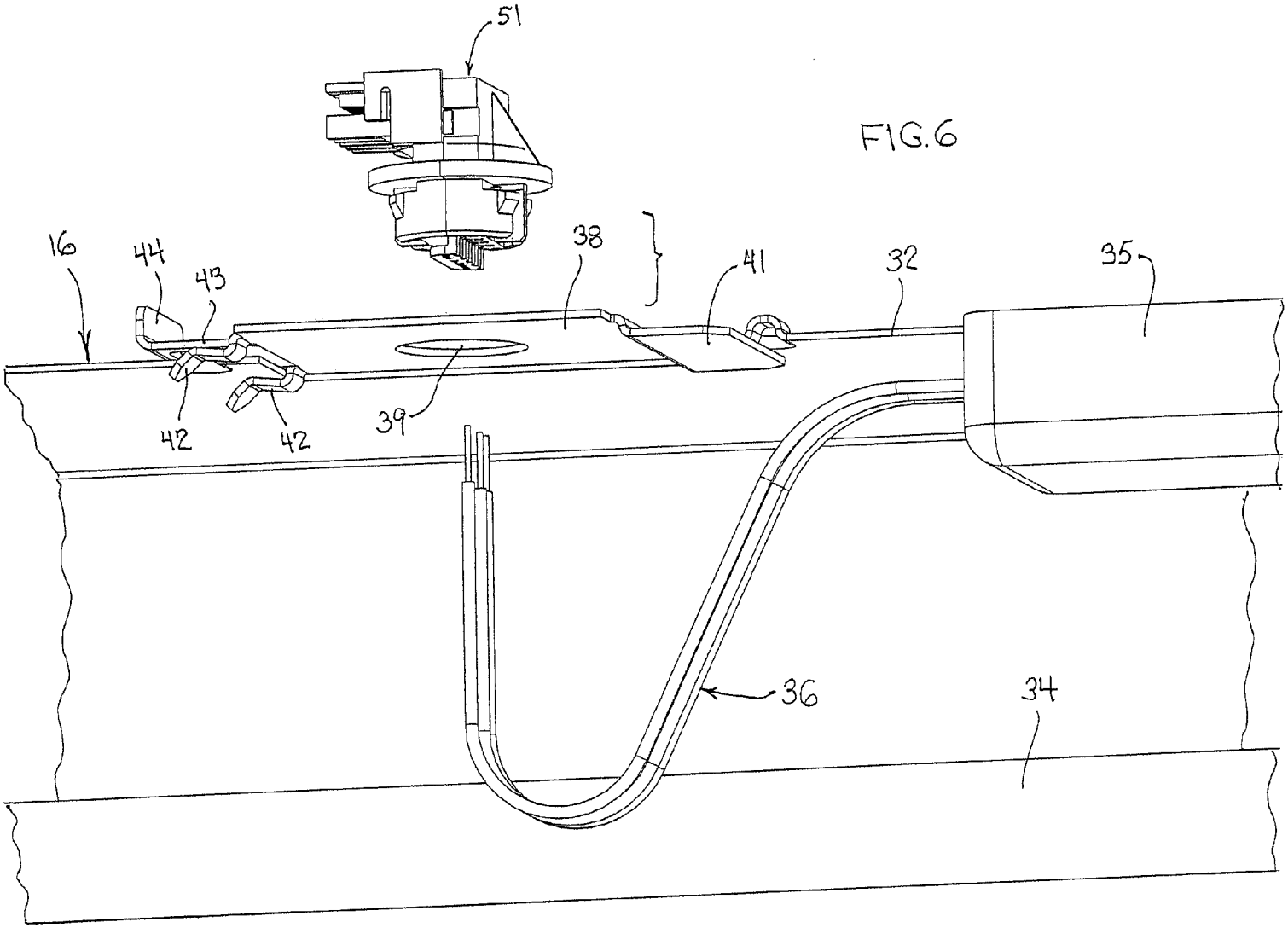
FIG. 6 is a perspective view which shows a part of the upper light fixture housing and the removable cover, and specifically showing the adapter module and pigtail conductors associated with the ballast of the light fixture.
Figure 7:
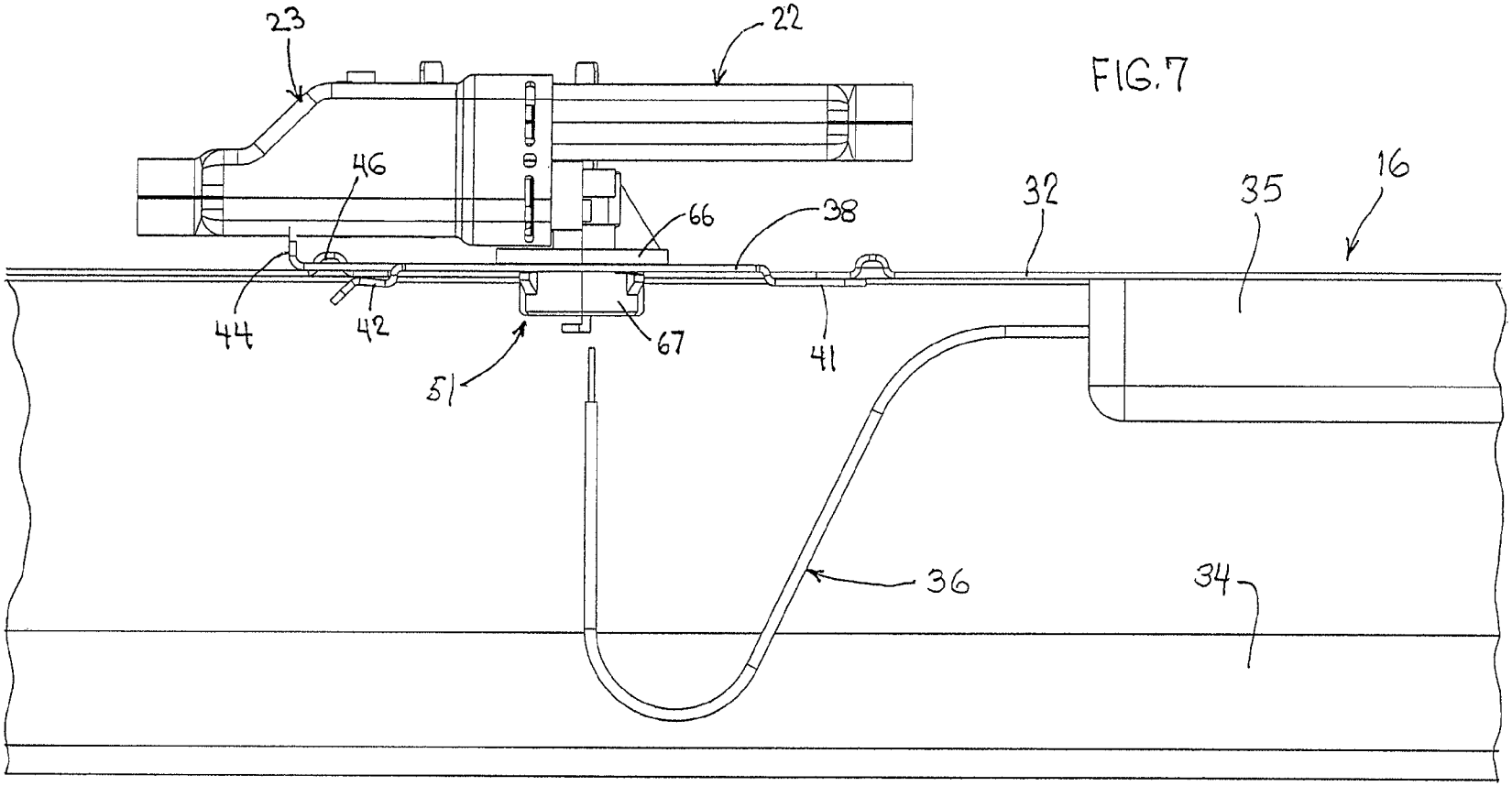
FIG. 7 is a fragmentary side elevational view which generally corresponds to FIG. 6, but which additionally shows the adapter mounted on the light fixture housing and having a plugged engagement with a downstream end of a flexible conduit unit which is part of the overall power distribution assembly.

The light fixture 16, as illustrated by FIGS. 3-5, is typically provided with an access opening 37 formed in the top wall 32. This access opening 37 is typically closed or covered by a removable cover plate 38 which overlies the access openings adjacent an upper side of the top wall 32. The cover plate 38 has a width which is slightly greater than the width of the opening 37, and typically has a knockout port 39 formed therein. The port 39 conventionally defines a $\frac{7}{8}^{th}$ inch diameter opening communicating downwardly with the interior of the light fixture chamber to enable an external power supply conduit to be passed therethrough for connection to the ballast pigtail 36.

The cover plate 38 is fixedly but removably attachable to the top wall 32. The plate 38 has a securing flange 41 which is depressed downwardly but projects outwardly a substantial distance beyond one end edge of the cover plate 38 so as to be positionable under the top wall 32. Cover plate 38 adjacent an opposite edge thereof has a pair of secondary securing flanges 42 positioned adjacent opposite ends of the plate edge and protruding downwardly and outwardly through a smaller extent so as to protrude under an opposite end edge of the opening 37. In addition, the cover plate 38 has a length which is slightly less than the length of the access opening 37.

Cover plate 38 additionally has a top flange 43 which projects outwardly from the same edge of the cover plate as the secondary flanges 42, although the top flange 43 is generally co-planar with the cover plate and protrudes outwardly through a great extent, and at its outer edge terminates in an up turned tab or flange 44. With this geometry, the cover plate 38 is secured to the top wall 32 by positioning the cover plate in upward angled relationship so that the flange 41 protrudes downwardly through the opening 37 and under the adjacent edge thereof. The cover plate 38 is then swingably moved downwardly so that the secondary flanges 42 pass through the opening until the top flange 43 rests on the top wall 32. The cover plate 38 is then slidably displaced to cause the secondary flanges 42 to pass under the adjacent edge of the opening, thereby securing the cover plate to the top wall 32 by sandwiching the edge of the opening 37 between the flanges 42 and 43. The top flange 43 is also optionally provided with an elongate slot 45 therethrough which, when the cover plate is in the closed position, accommodates therein a protrusion 46 which is formed in and projects upwardly from the top wall 32. The top flange 43 preferably has sufficient resiliency to enable it to be deflected upwardly whereby the protrusion 46 can engage within the slot 45.

Alternately, the cover plate 38 can be secured to top wall 32 by use of conventional fasteners such as screws.

In accordance with the present invention, as illustrated in FIG. 5, there is provided an improved fixture adapter module 51 which is designed for direct mounting on the light fixture, such as by being secured within and projecting through a knockout port thereof, preferably the knockout port 39 associated with the cover plate 38. The adapter module 51 is constructed and configured to permit it to be plug-engaged to the modular power distribution assembly 10, namely plug connected to the downstream end of the flexible conductor unit 21, and is also adapted for direct connection to the protruding ends of the pigtail conductors 36 associated with the light fixture ballast, as explained in detail hereinafter.

More specifically, the modular adapter 51 includes an electrical input 54 at one end thereof, namely the upstream end of the adapter, and also includes an electrical output 55 at an opposite end thereof, this being the downstream end. The input 54 at the upstream end of the adapter is oriented to project sidewardly (i.e., horizontally) relative to the usual vertical orientation of the adapter, as illustrated in FIG. 5. At the same time, the output 55 as associated with the lower end is typically oriented so as to project downwardly.

The electrical adapter 51 is defined by a housing 52 of electrically insulative material, which housing 52 supports and substantially surrounds a family of electrical conductors 53 (FIG. 15) which extend between and define electrical contacts at the input and output 54 and 55, respectively. The family of electrical conductors 53 typically and preferably includes five such conductors which are disposed in sidewardly spaced relationship and extend in parallel relationship between the input 54 and output 55. These five conductors permit connection to three live, a neutral and a ground conductor.

Figure 17:
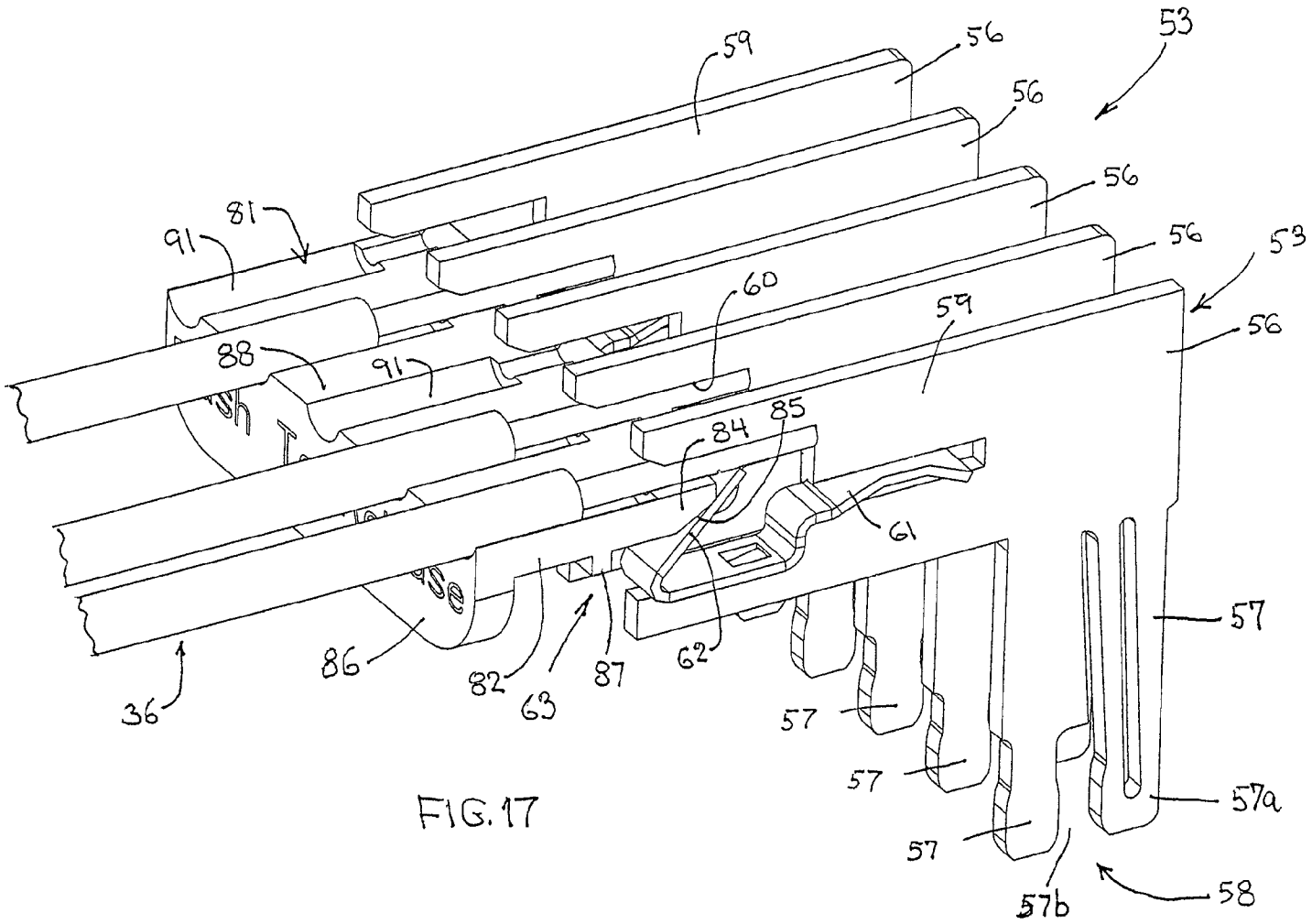
FIG. 17 is a perspective view which illustrates the family of conductors associated with the adapter module, and their engagement with pigtail conductors from the light fixture, the front and rear housing parts being removed for purposes of illustration.
Figure 18:
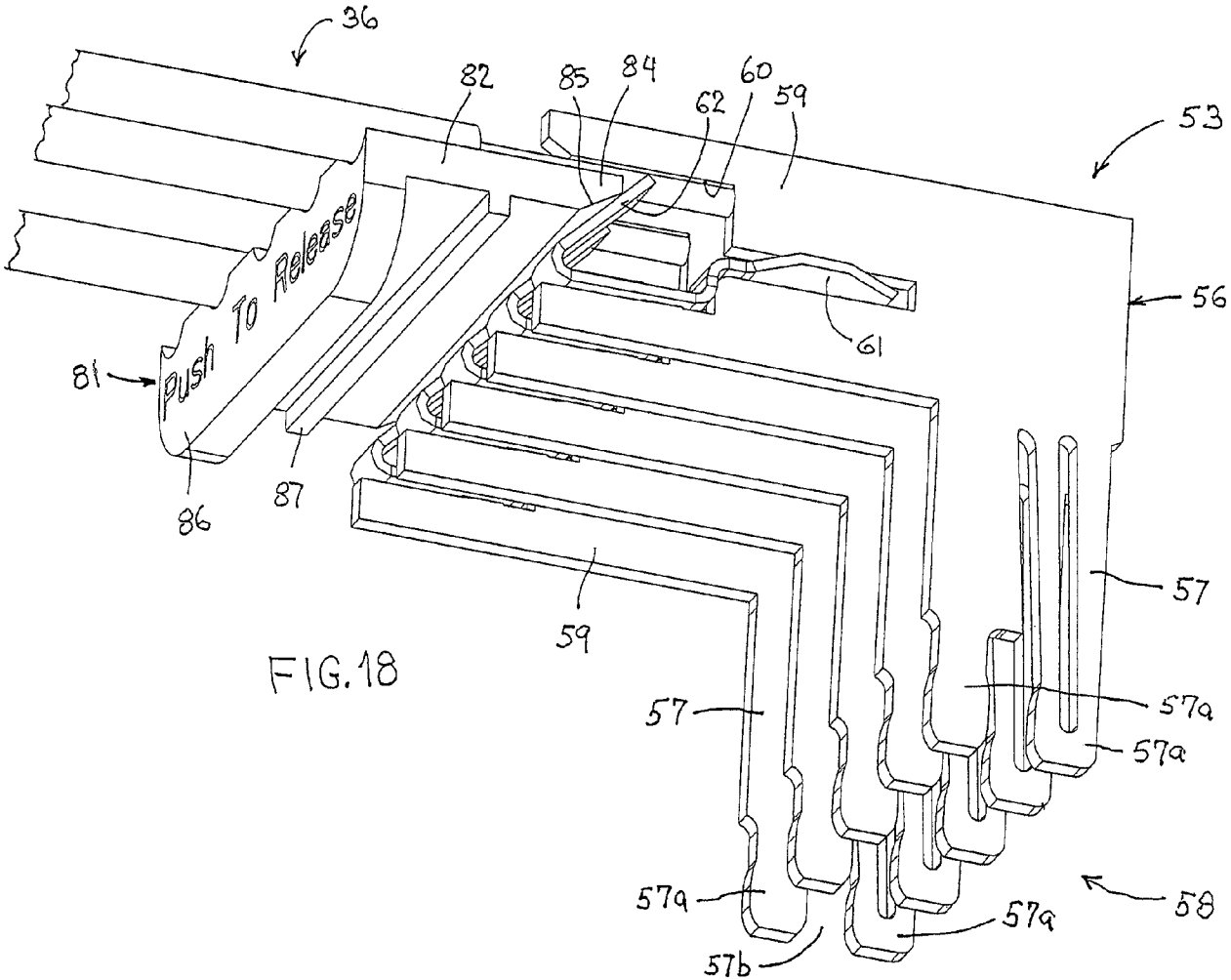
FIG. 18 is a further perspective view which illustrates the same arrangement as FIG. 17 but from a different angular perspective.

Referencing FIGS. 17 and 18, each conductor 53 of the family is defined by a generally upper L-shaped conductive plate 56 which has an upper generally horizontal part or leg 57 which, adjacent the free end, defines a pair of contact parts 57*a* separated by a slot or slit 57*b*. The legs 57 of the conductors 53 protrude in generally parallel relationship and cooperate with the adapter housing to define a plug-type electrical connector 58 at the input 54 of the adapter. This plug-type connector 58 is identical to the plug connector 22A associated with the conductor unit 21, and hence can be engaged with a plug connector 23B.

Each conductor 53 also includes a second or lower conductive member 61 which is supportingly engaged in electrical contact with a lower vertically projecting leg 59 of the respective L-shaped conductive plate 56. This second or lower conductive member 61 protrudes outwardly from the lower leg 59 and terminates at its lower end in a plate-like contact part 62 which is angled upwardly and is cantilevered so as to terminate in a free end. The cantilevered contact parts 62 and their close opposed relationship to the contact surfaces 60 on the legs 59 define a plug-in socket-type electrical connector 63 which defines the output 54 of the adapter 51, and which is adapted for electrical contacting engagement with the pigtail conductors 36 associated with the light fixture. The cantilevered contact part 62 protrudes toward and terminates in a free end which is spaced a small distance from the elongate and generally flat surface 60 defined on the conductive lower leg 59 of the respective conductive plate 56. The spacing between the surface 60 and the tip of the contact part 62 is normally less than the diameter of the conductive wire defining the pigtail wire 36 so that the conductive pigtail wire can be slidably inserted into this space, causing deflection of the cantilevered contact part 62, and hence creating electrically conductive gripping engagement of the pigtail wire between the surface 60 and the tip edge of the contact part 62.

Figure 13:
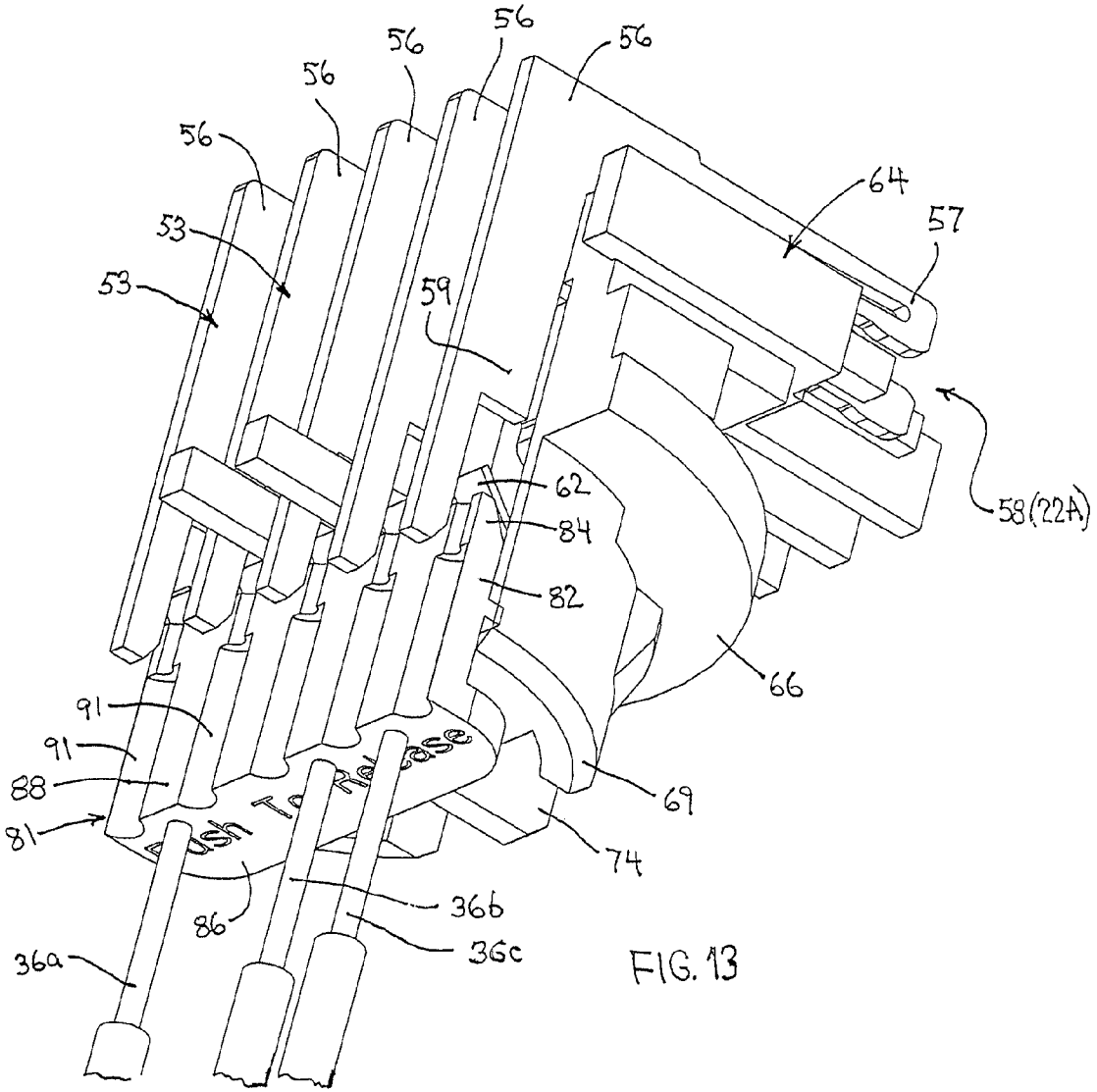
FIG. 13 is a perspective view of the adapter module showing the front part of the housing and the family of electrical conductors mounted thereon, the rear part of the housing being removed for purposes of illustration.
Figure 14:
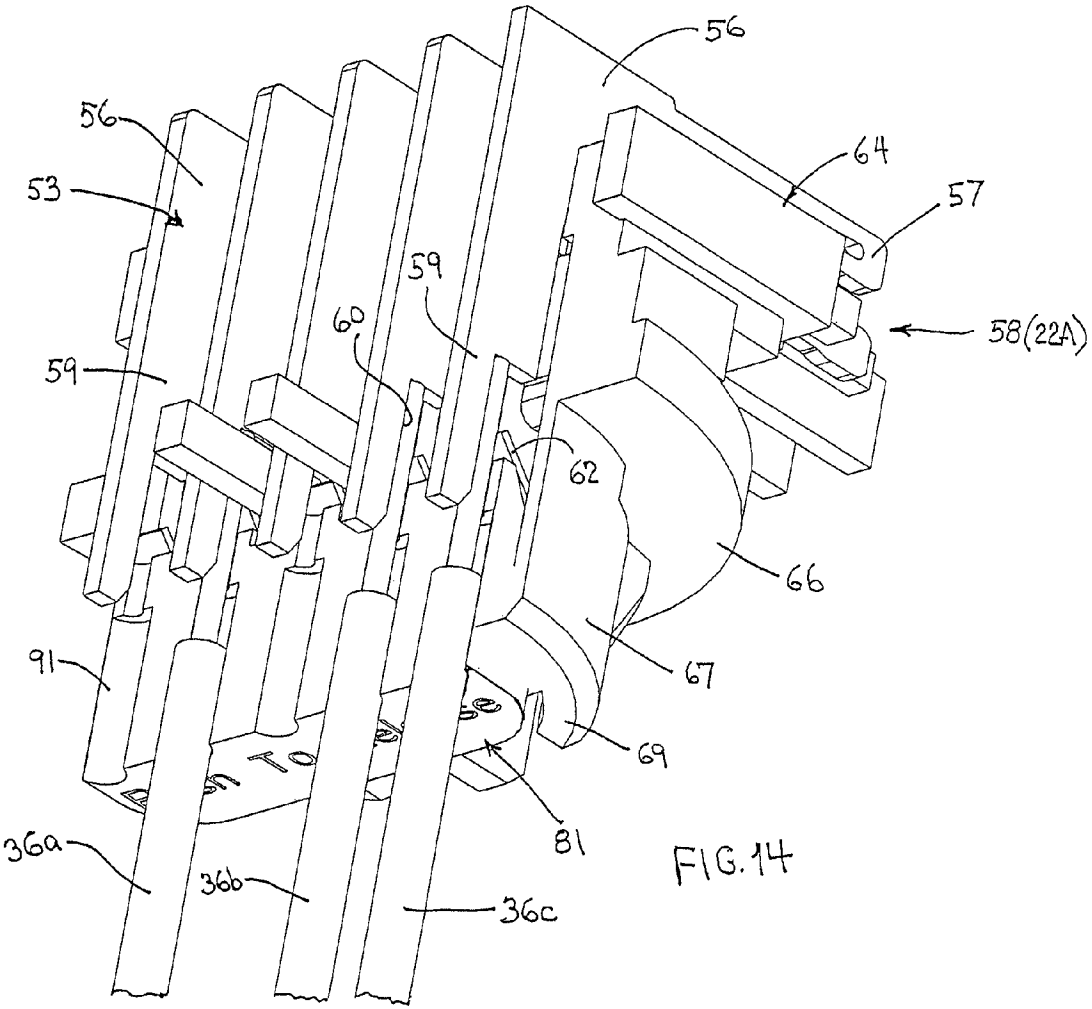
FIG. 14 is a perspective view which corresponds to FIG. 13 but illustrating the pigtail conductors from the light fixture engaged with the conductors of the adapter module.
Figure 15:
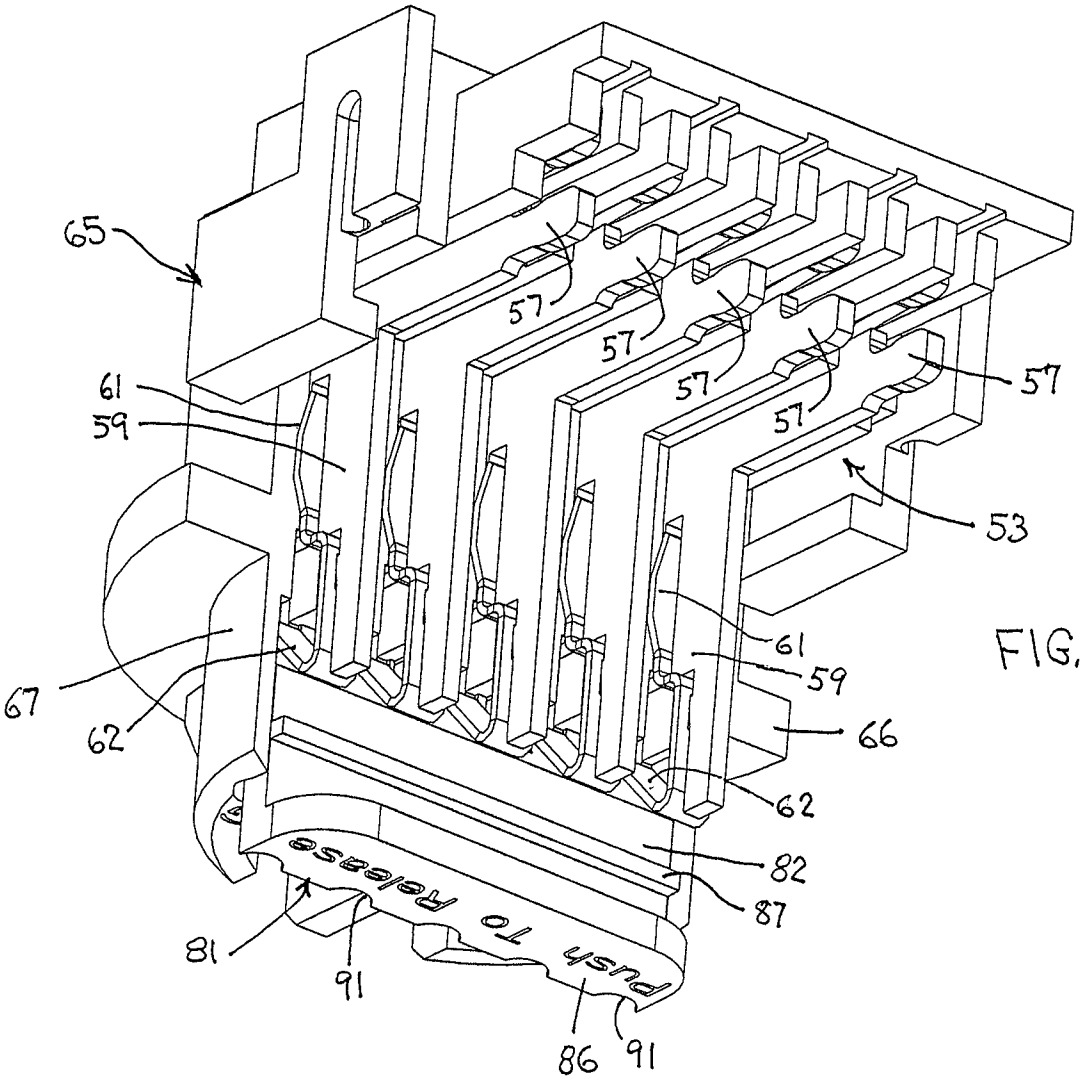
FIG. 15 is a perspective view of the adapter module showing the family of electrical conductors and their association with the rear part of the housing, the front part of the housing being removed for purposes of illustration.
Figure 16:
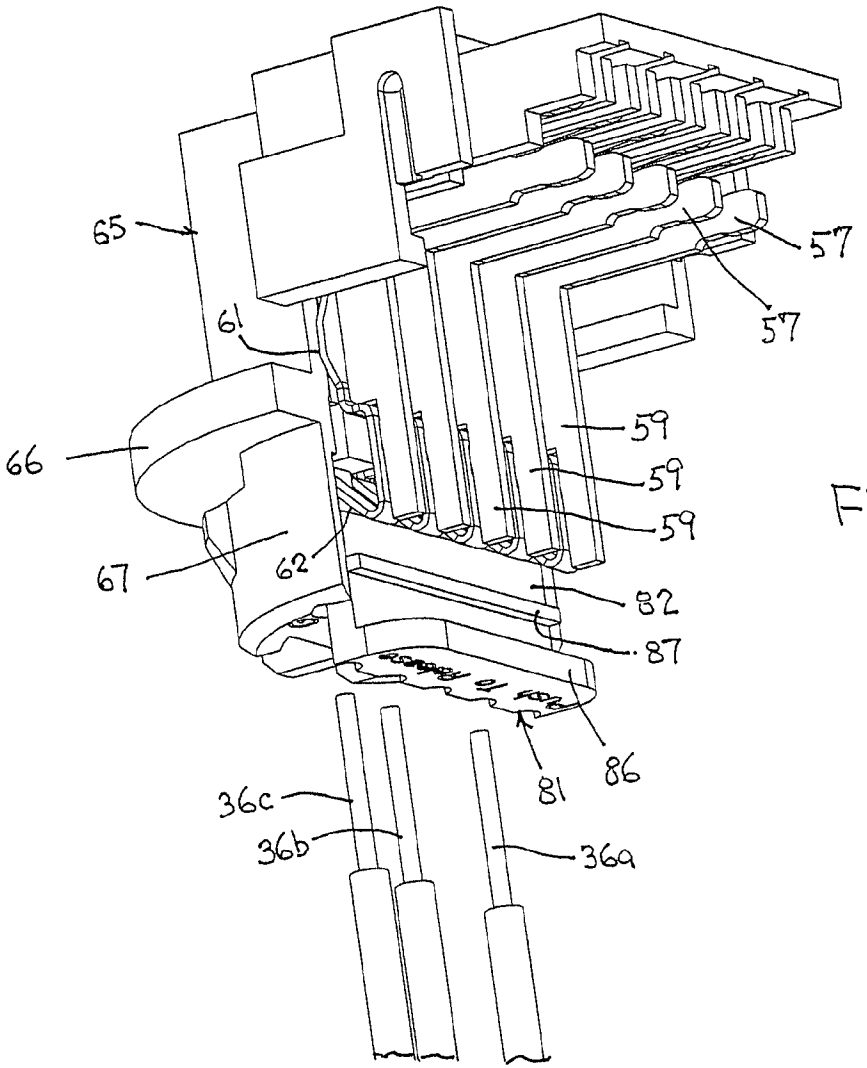
FIG. 16 is a further perspective view showing the partial adapter module of FIG. 15 from a slightly different orientation.

The housing 52 (FIGS. 10-16) effectively surrounds and supports the family of conductors 53 in the positional relationship illustrated by FIGS. 17 and 18, and for this purpose the housing includes two primary housing parts, namely front and rear housing parts 64 and 65 respectively, which effectively support and enclose the conductors 53 therebetween while at the same time allowing access to the plug-like connector contacts 58 disposed at the input 54 and the receptacle-type connector contacts 63 defined at the output 55. FIGS. 13 and 14 illustrate the family of conductors 53 positionally supported on and within the front housing part 64, which front part 64 also extends over the top of the adapter, the rear housing part 65 being removed for purposes of illustration. Similarly, FIGS. 15 and 16 illustrate the family of conductors 53 positionally supported on and within the rear housing part 65, the front housing part 64 being removed for purposes of illustration.

The front and rear housing parts 64 and 65 are fitted and rigidly joined together so as to securely and safely support and enclose the family of electrical conductors 53 therein. When so joined, the resulting electrical adapter 51 has the configuration illustrated by FIGS. 10-12. Specifically, the housing 52 includes a main support plate or flange 66 which is disposed generally intermediate the upper and lower ends of the housing and is configured generally as a horizontal plate of generally circular configuration which protruding radially outwardly and has a horizontal diameter which at least slightly exceeds the diameter of the knockout port 39. The support flange 66 is defined generally by semi-cylindrical flange parts 66A and 66B as respectively defined on the housing parts 64 and 65. The semi-cylindrical flange parts effectively abut when the housing is assembled so as to define a generally circular configuration.

The housing 52 also includes a generally cylindrical sleeve-like mounting hub 67 which is fixed to and protrudes coaxially downwardly from the support flange 66 and which effectively terminates at a lower free end which defines the lower end of the housing 52. The hub 67 has, in its normal condition, an outer diameter which is typically only slightly smaller than the diameter of the knockout port 39 to enable the hub 67 to pass downwardly through the knockout port.

The cylindrical hub 67 is defined by two substantially semi-cylindrical hub sectors 67A and 67B which are fixedly associated with the support flange sectors 66A and 66B, respectively. Each of the hub sectors 67A and 67B includes a web plate 68 which extends across the sector in close proximity to the diameter thereof, and this web plate adjacent opposite ends joins to a pair of arcuate sectors 69 which angle outwardly away from the web plate 68 generally toward one another to define the outer cylindrical profile of the hub. The arcuate sectors 69 individually project outwardly through angles less than 90°, and terminate in free ends 71 which are disposed in opposed but spaced relationship from one another. The arcuate sectors 69 individually have a cantilevered relationship due to their joinder solely adjacent the respective end of the diametral web plate 68. These arcuate sectors are designed so as to enable them to resiliently deflect inwardly.

Each arcuate sector 69, adjacent the respective free end 71 thereof, and at a location disposed adjacent but spaced downwardly a small distance below the respective support plate sector 66A or 66B, is provided with a latch or projection 72 formed exteriorly of the sector and protruding radially outwardly therefrom. The latch 72 has a lower surface 73 which tapers upwardly as it projects radially outwardly away from the surface of the respective sector 69. This construction of the support hub 67, namely the provision of resiliently deflectable cantilevered sectors 69, and latches 72 provided thereon adjacent the upper outer corners thereof, enables the hub 67 to be initially fitted into the knockout port 39 and moved downwardly therein. The downward movement of the hub 67 into the knockout port continues until the edge of the knockout port 39 engages the ramps 73 associated with the latches 72. Continued downward displacement of the hub causes the sectors 69 to deflect inwardly, allowing the latches 72 to pass through the knockout port 39. After the entire latch 72 passes through the port 39, the resiliency of the sectors 69 causes them to snap back to their original cylindrical configuration, resulting in the latches 72 being moved outwardly beneath the top wall 32 or cover plate 38 in close proximity to the outer diameter of the knockout port 39, whereby the edge of the top wall 32 or cover plate 38 is confined in the narrow slot which is defined between the upper surfaces of the latches 72 and the lower surface of the cylindrical support flange 66. This retains the adapter 51 to the top wall 32 of the light fixture, but at the same time preferably retains the adapter 51 with sufficient looseness to allow the adapter to be rotatably displaced within the knockout port so as to permit it to be suitably angularly oriented for convenient connection to the modular power distribution system.

To assist in maintaining the housing 52 of the adapter 51 properly positioned within the knockout port, the housing 52 is provided with a positioning rib or flange 74 associated with each of the hub sectors 67A and 67B, which rib 74 protrudes generally perpendicularly outwardly from the respective web plate 68 into the gap or spacing between the opposed free ends 71 of the arcuate sectors 69. The rib or plate 74 has a width, relative to the normal spacing between the opposed ends 71, so as to not interfere with or restrict inward resilient deflection of the sectors 69 during installation of the adapter into the port. In addition, the positioning plate 74 has an outer edge surface 75 which is positioned such that the diametral spacing between the surfaces 75 on opposite sides of the hub has a dimension (i.e. diameter) which closely equals but is preferably slightly less than the diameter of the knockout port 39. The positioning plates 74 hence cooperate with the edge of the knockout opening 39 so as to ensure that the adapter 51, when mounted within the knockout port, remains positionally centered.

The electrical adapter 51 is additionally provided with a release member 81 (FIGS. 13-18) which is slidably supported on the housing 52 and protrudes downwardly from the lower or output end to permit manual access thereto. The release member 81 cooperates with the contact parts 62 so as to effect disengagement thereof from the pigtail conductors 36 in the event that disconnection is required, such as to permit replacement of the ballast.

The release member 81 is formed primarily by a plate-like member 82 which is slidably supported within and guided by a recess or cutout 83 formed in one of the diametral web plates 68, whereby the slide member 82 extends generally diametrically across the cylindrical hub of the adapter housing and projects vertically upwardly (i.e. axially) into the interior thereof. The slide plate 82 adjacent its upper end terminates in a nose part 84 which extends across the housing so as to be maintained substantially in abutting contact with the plurality of contact parts 62 in close proximity to the outer free ends thereof. The underside of the nose part 84 is provided with a taper 85 to facilitate contacting of the nose part 84 with the contacts 62 in close proximity to the free edges thereof. The slide member 82 projects outwardly beyond the lower free end of the mounting hub 67 and, at its lower free end, is provided with a transverse flange 86 to facilitate manual gripping or engagement with the lower end of the release member 81. The slide member 82 has a rib 87 protruding outwardly therefrom at a location disposed within the mounting hub. This rib 87 extends generally across the width of the slide plate 82, and is disposed within a groove 89 (FIG. 19) formed in the housing so that the contact plates 62 normally engage the nose part 84 and apply a very small resilient pressure urging the slide member 82 outwardly (i.e. downwardly) so that rib 87 contacts a lower wall of the retaining groove 89.

In a situation requiring disconnection of the ballast pigtail conductors 36 from the electrical adapter 51, servicing or repair can be easily effected by manually engaging the flange 86 and pushing the slide plate 82 inwardly of the housing 52 so that the nose end 84 deflects the contacts 62 away from the conductors 36. With the contact plates 62 maintained in this deflected position, the conductors 36 can be manually withdrawn from the electrical adapter 51, thereby permitting servicing or replacement of the ballast. This servicing can be carried out by accessing the light fixture from below.

In addition to the servicing function carried out by use of the release member 81, it also functions as a guide to facilitate insertion and connection of the ballast pigtail conductors 36 to the electrical adapter 51. For this purpose, the enlarged exposed side surface 88 of the slide plate 82 has a series of parallel grooves or recesses 91 formed therein, each extending along the surface from the free lower edge thereof. The grooves 91 are positioned for alignment with the respective gaps defined between the contact surfaces 60 and the respectively opposed edges of the contact plates 62. The opposed surface of the diametrical web plate has similar grooves or recesses 92 (FIG. 12) formed therein which, in cooperation with the grooves 91, effectively define a series of generally cylindrical openings, there being five such openings which respectively align with each of the gaps so that the pigtail conductors 36 of the ballast can be slidably inserted into a selected three of the groove-defined openings for creating electrical and mechanical contacting engagement with the respective conductors 53.

The installation and operation of the electrical adapter 51, specifically when used in conjunction with a light fixture 16 similar to that illustrated in the drawings, will now be briefly described.

Figure 8:
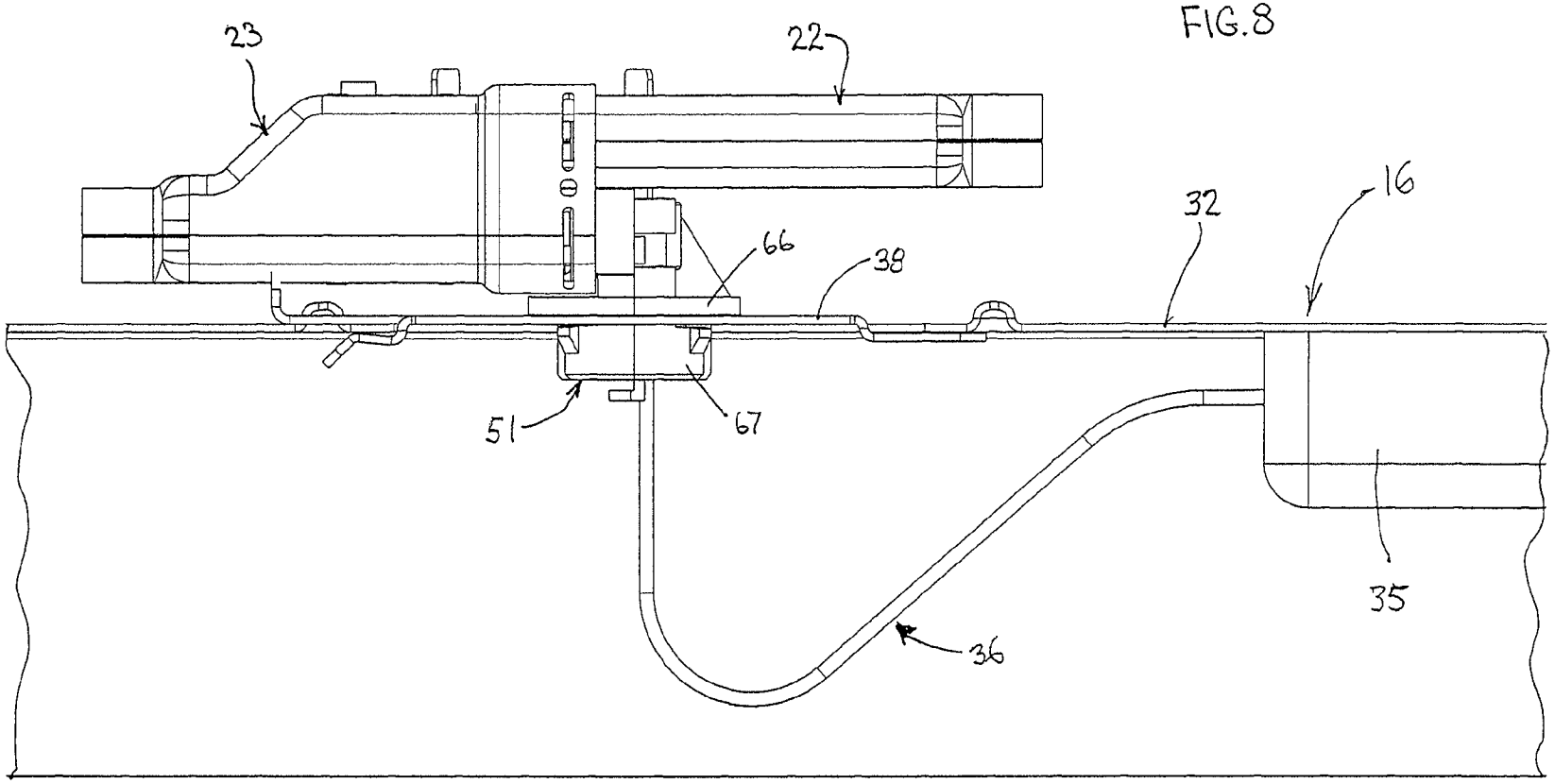
FIG. 8 is a side elevational view corresponding to FIG. 7 but showing the pigtail conductors associated with the light fixture ballast plugged into ports defined on the lower end of the adapter module.
Figure 9:
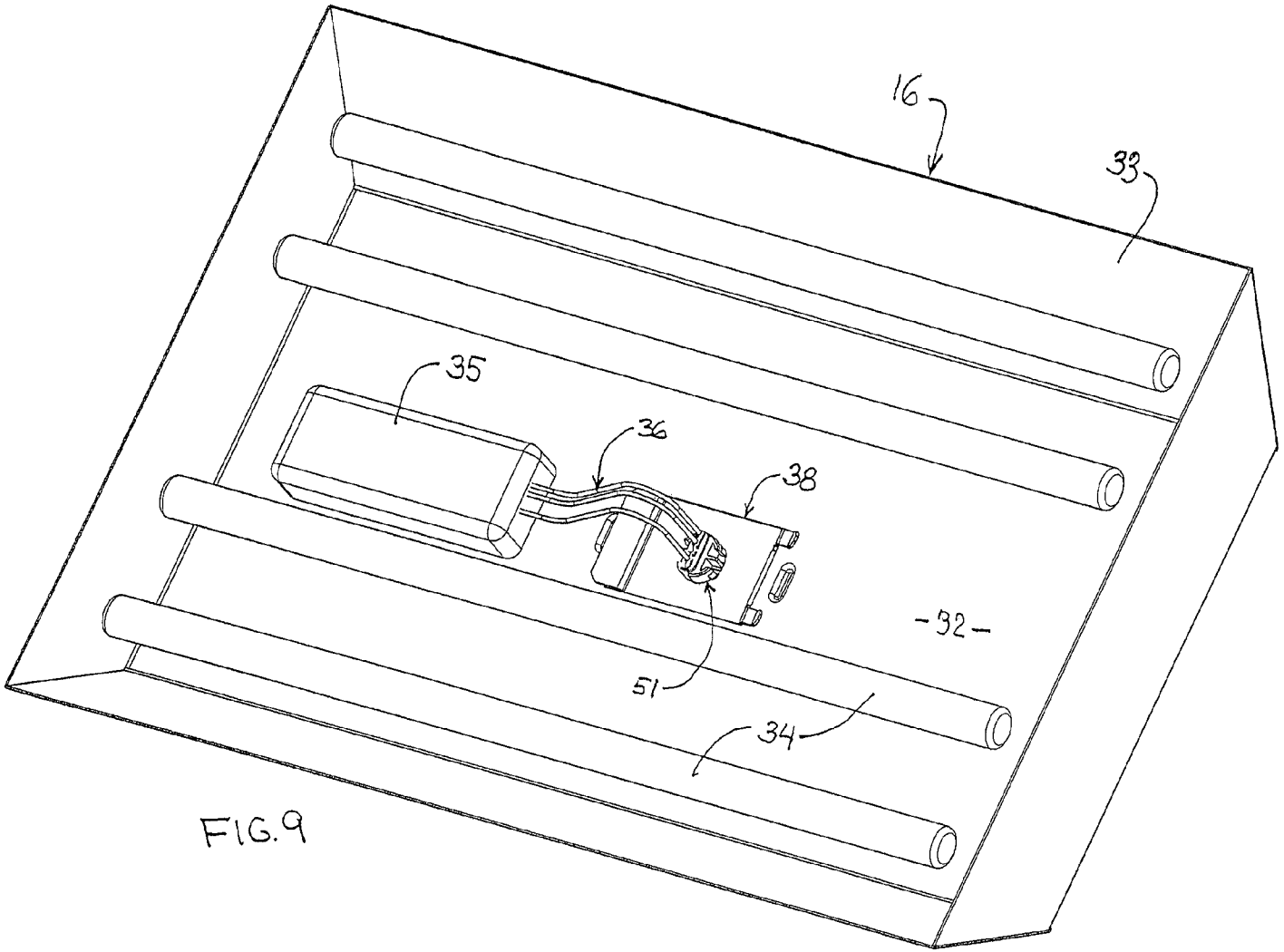
FIG. 9 is a perspective view, taken generally from below, showing the interior of the light fixture.
Figure 9A:
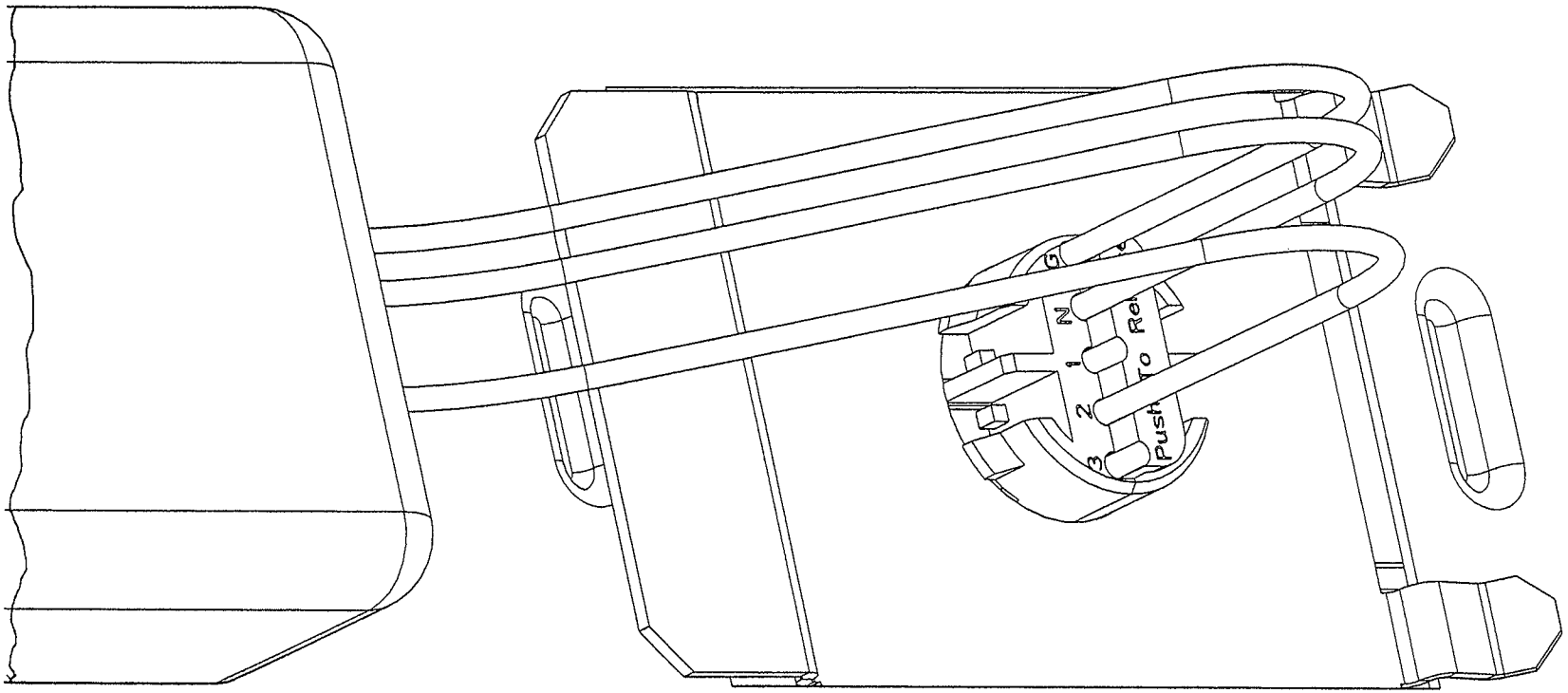
FIG. 9A is an enlargement of a portion of FIG. 9.
Figure 10:
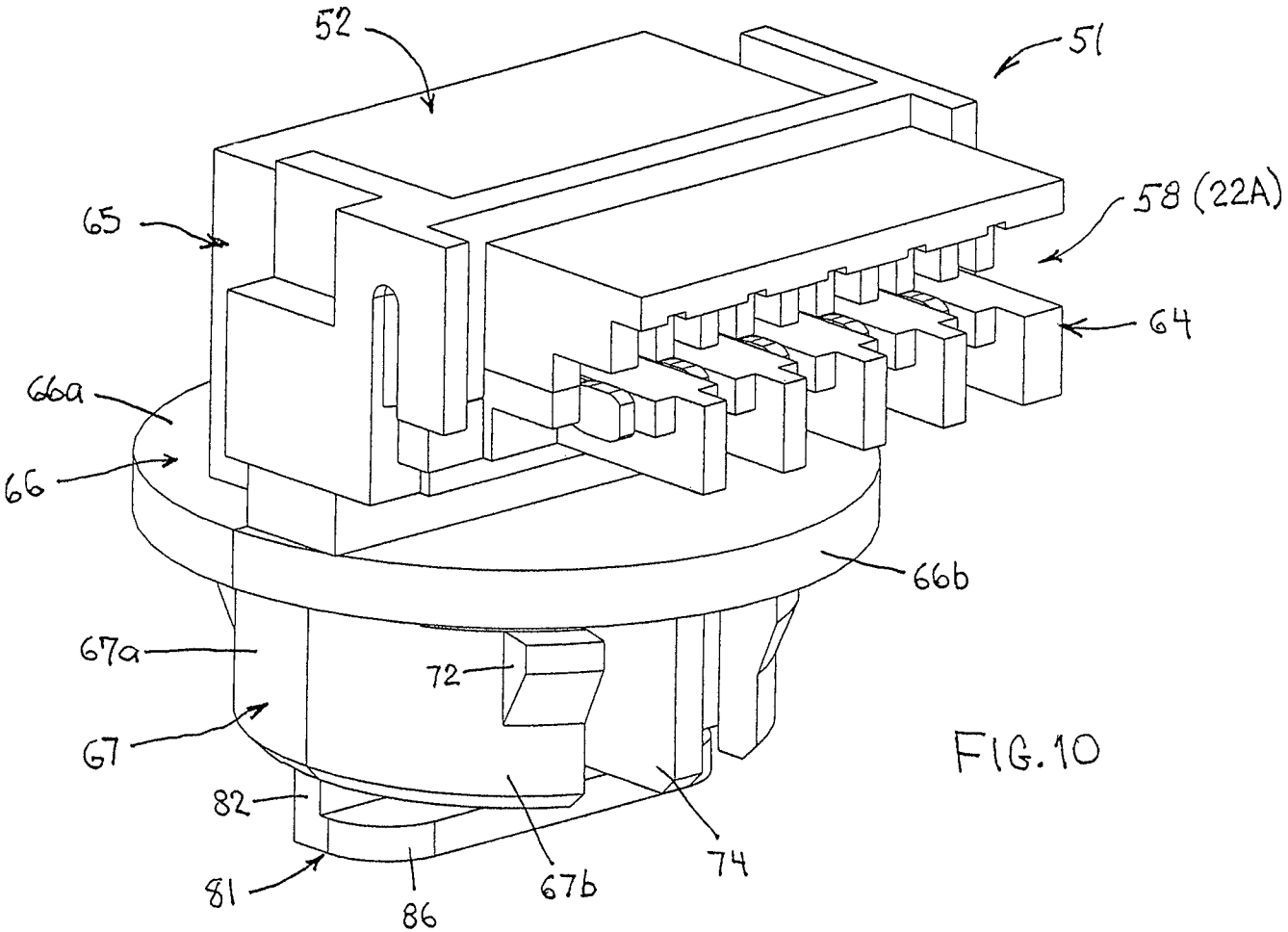
FIG. 10 is a perspective view of the adapter module which connects between the power distribution system and the light fixture in accordance with the invention.
Figure 11:
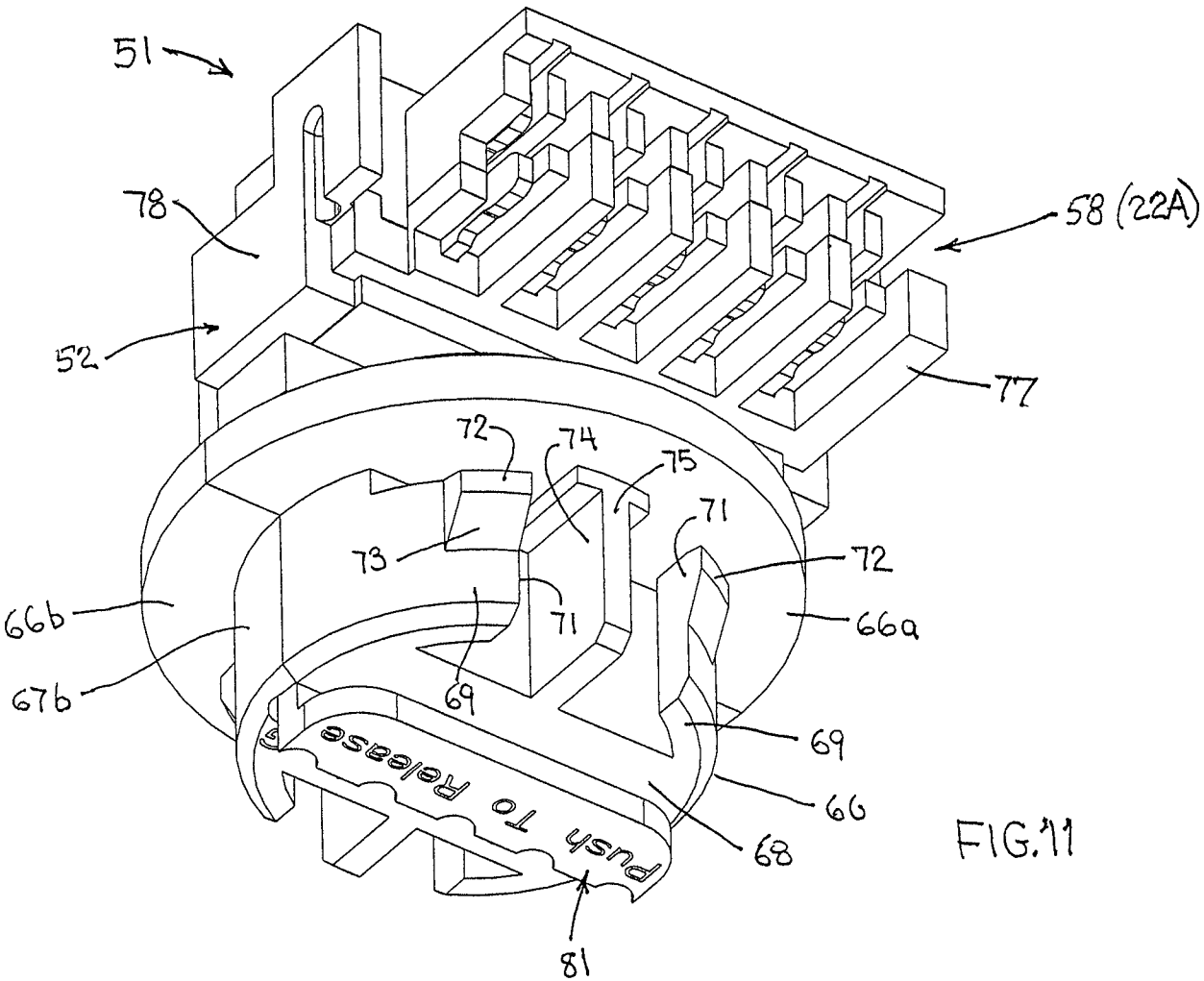
FIG. 11 is a further perspective view of the adapter module taken from a different angular orientation.
Figure 12:
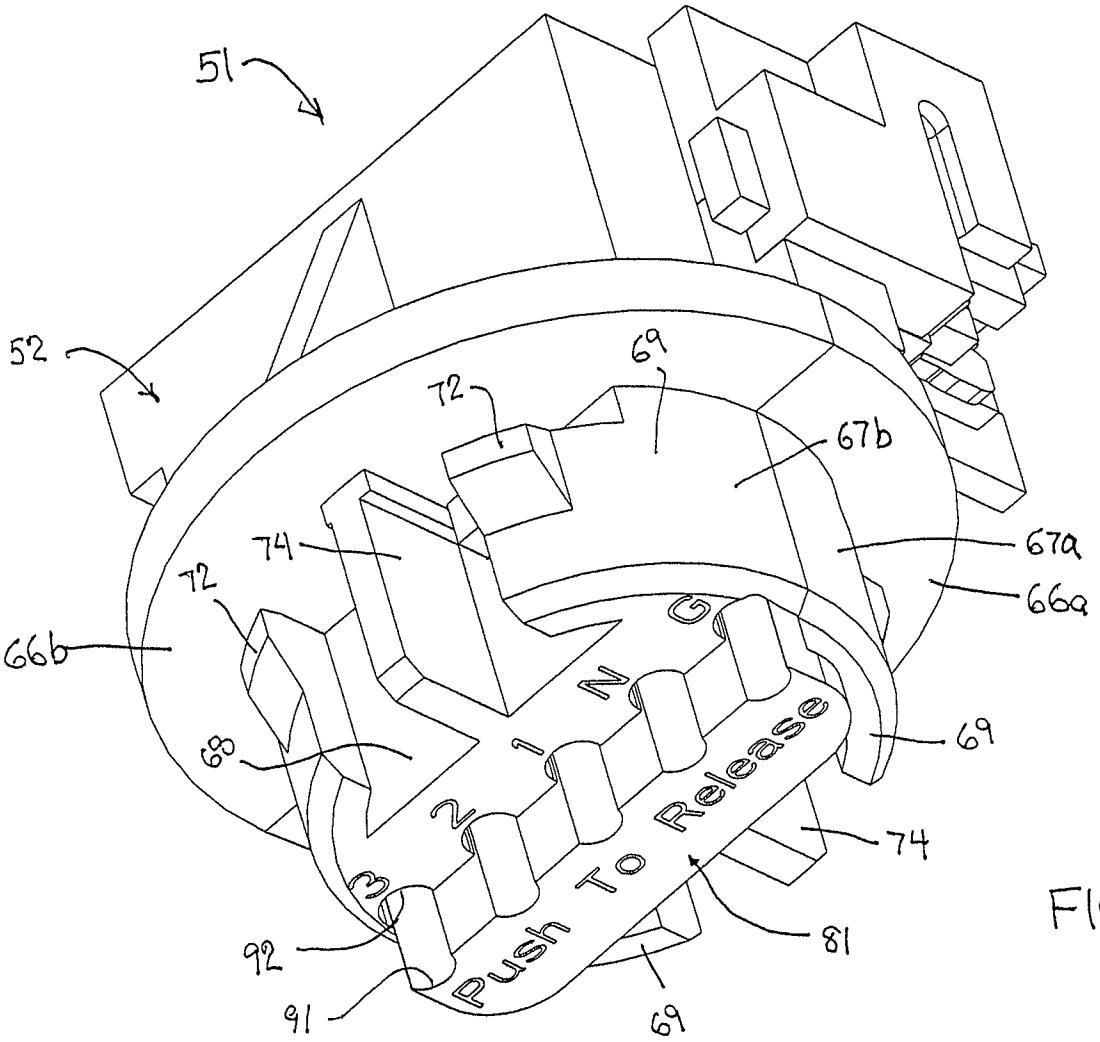
FIG. 12 is a still further perspective view of the adapter module as taken from the opposite side thereof as appearing in FIGS. 10 and 11.
Figure 19:
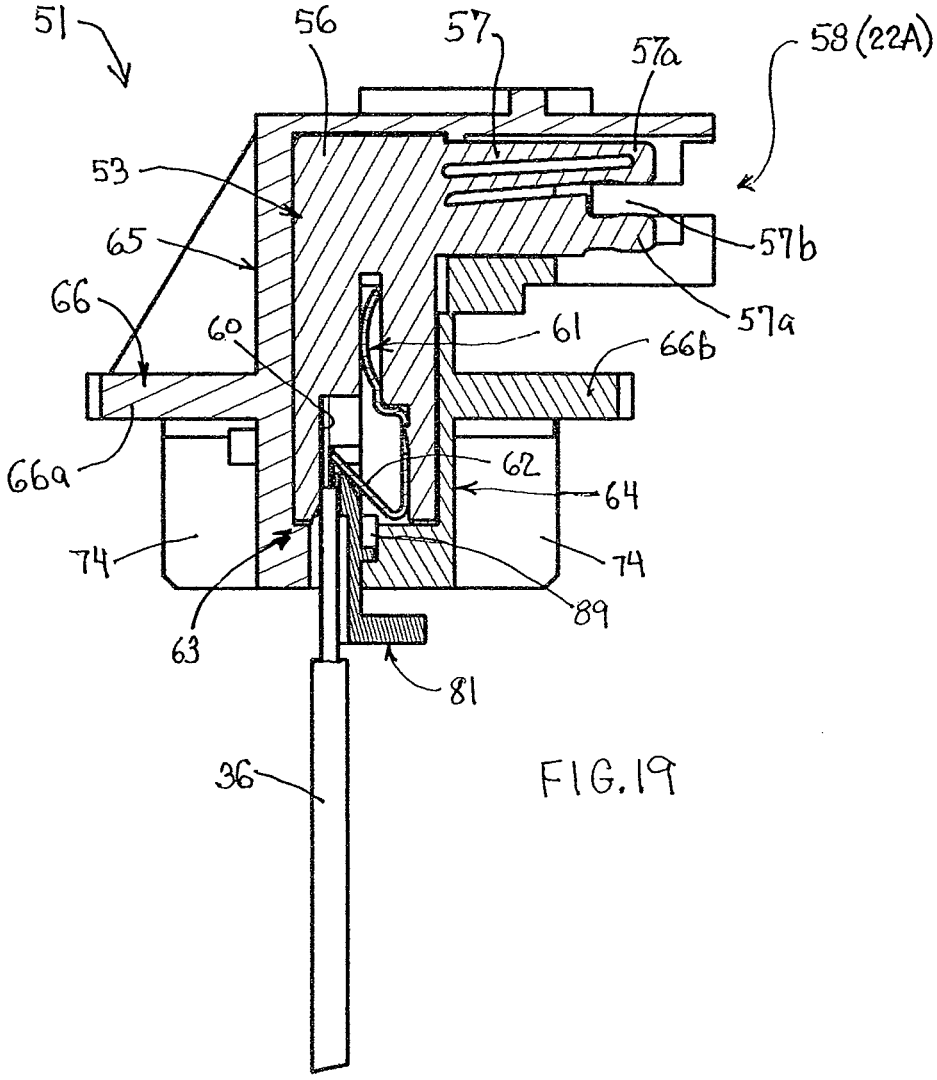
FIG. 19 is a central-sectional view showing one of the conductors associated with the adapter module prior to its engagement with one of the ballast pigtail conductors.
Figure 20:
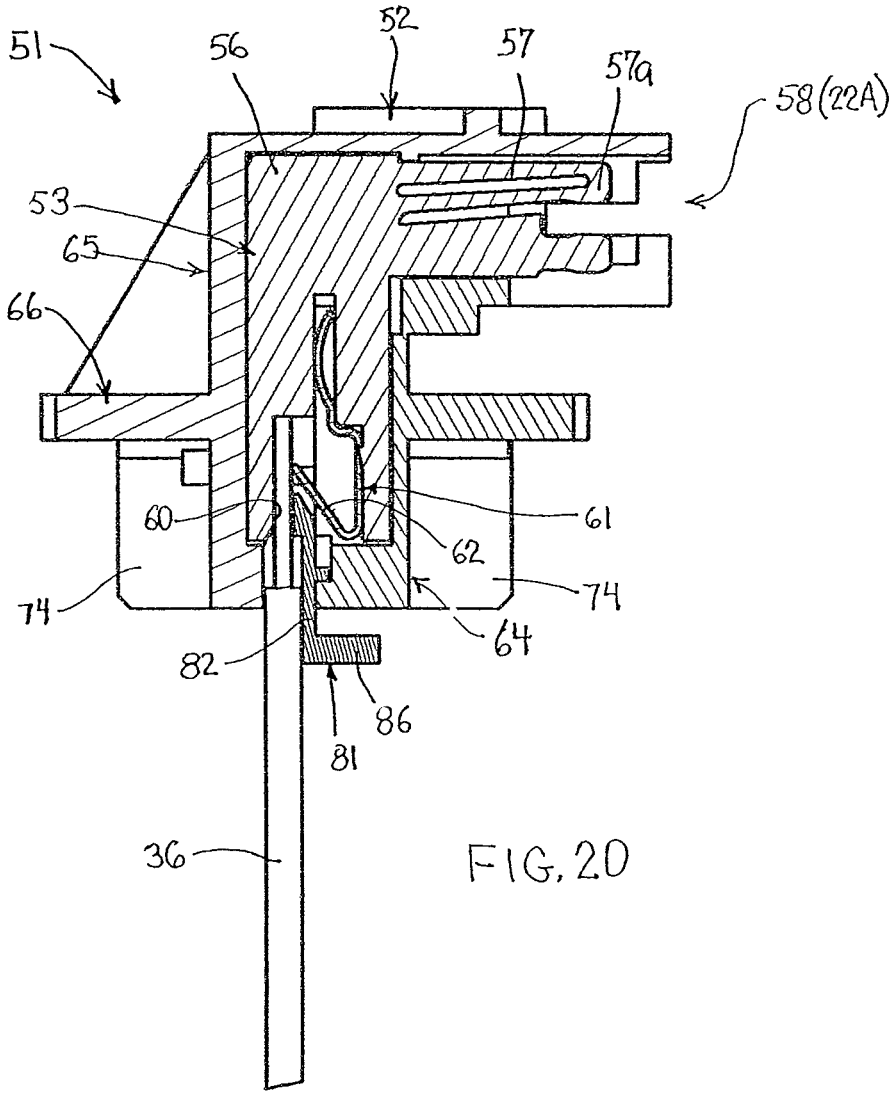
FIG. 20 is a sectional view which corresponds to FIG. 19 but shows the ballast pigtail conductor mechanically and electrically coupled to the adapter module.
Figure 20A:
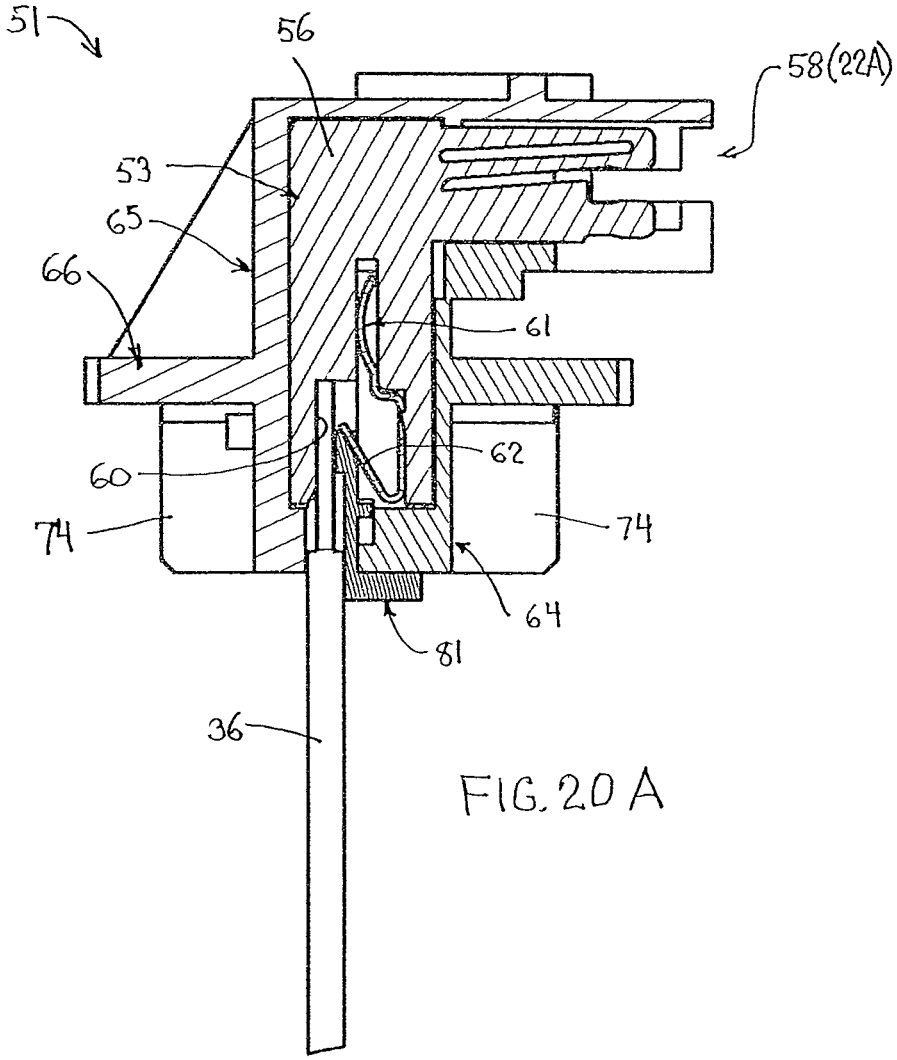
FIG. 20A is a sectional view which corresponds to FIG. 20 but illustrates the release slide in its manually displaced inner position to permit removal of the ballast pigtail conductor.

The installer will initially remove the cover plate 38, and will typically thereafter mount the electrical adapter 51 thereto by inserting the hub 67 through the knockout port 39 so as to cause the adapter housing to be moved into latching engagement around the periphery of the knockout port. The installer can reach through the access opening 37 in the top wall of the light fixture housing so as to access and withdraw the pigtail 36 upwardly through the access opening. The installer can then individually slide the pigtail conductors 36 into the individual openings defined by the opposed grooves 91-92, with one of the conductors being engaged with one of the live openings L1, L2 or L3, and the other two being engaged within the neutral opening N and the ground opening G. The pigtail conductor 36 is initially inserted into the selected opening as shown in FIG. 19, the adapter being shown in the normal disengaged position so that each contact plate 62 is slightly spaced from its respective opposed contact surface 60. The conductor 36 is then manually pushed into the adapter 51 so that the exposed conductor wire engages and deflects the respective contact plate 62, causing the conductor wire to be gripped between the opposed contacts 60 and 62 as shown in FIG. 20, thereby electrically coupling the ballast conductor to the adapter 51. This hence electrically and mechanically couples the pigtail conductors to the respective conductors 53 within the electrical adapter 51. The cover plate can then be repositioned over the access opening and secured to the top wall 32 of the light fixture 16. A downstream end connector 23 (FIG. 8) associated with a flexible conductor unit 21 can then be plugged into the plug connector 58 provided on the upper input end of the electrical adapter 51, thereby completing the electrical connection of the light fixture.

If a ganging connection to a further light fixture is desired, then the installer will utilize a conductor unit 21 having a double B connector (FIG. 8) associated with the downstream end 23 thereof, with the lower B connector being joined to the plug connection 58 on the light fixture adapter 51. The upper B connector can then have the A connector associated with an upstream end of a further conductor unit 21 plugged therein so as to permit the other end of this additional electrical conductor unit to be electrically joined to a further light fixture.

While the assembly operation described above relates to mounting of the adapter 51 to the light fixture at the installation site, nevertheless it will be recognized that the adapter 51 can be easily and efficiently mounted on the cover plate, and coupled to the ballast connectors 36, at the factory so as to permit complete assembly prior to shipment. Such then permits mounting of the light fixture at the job site, and easy and convenient electrification of the light fixture by simply plugging the downstream connector 23 of a power distribution unit 21 into the input electrical connector 58 associated with the exposed upper end of the adapter 51.

Figure 21:
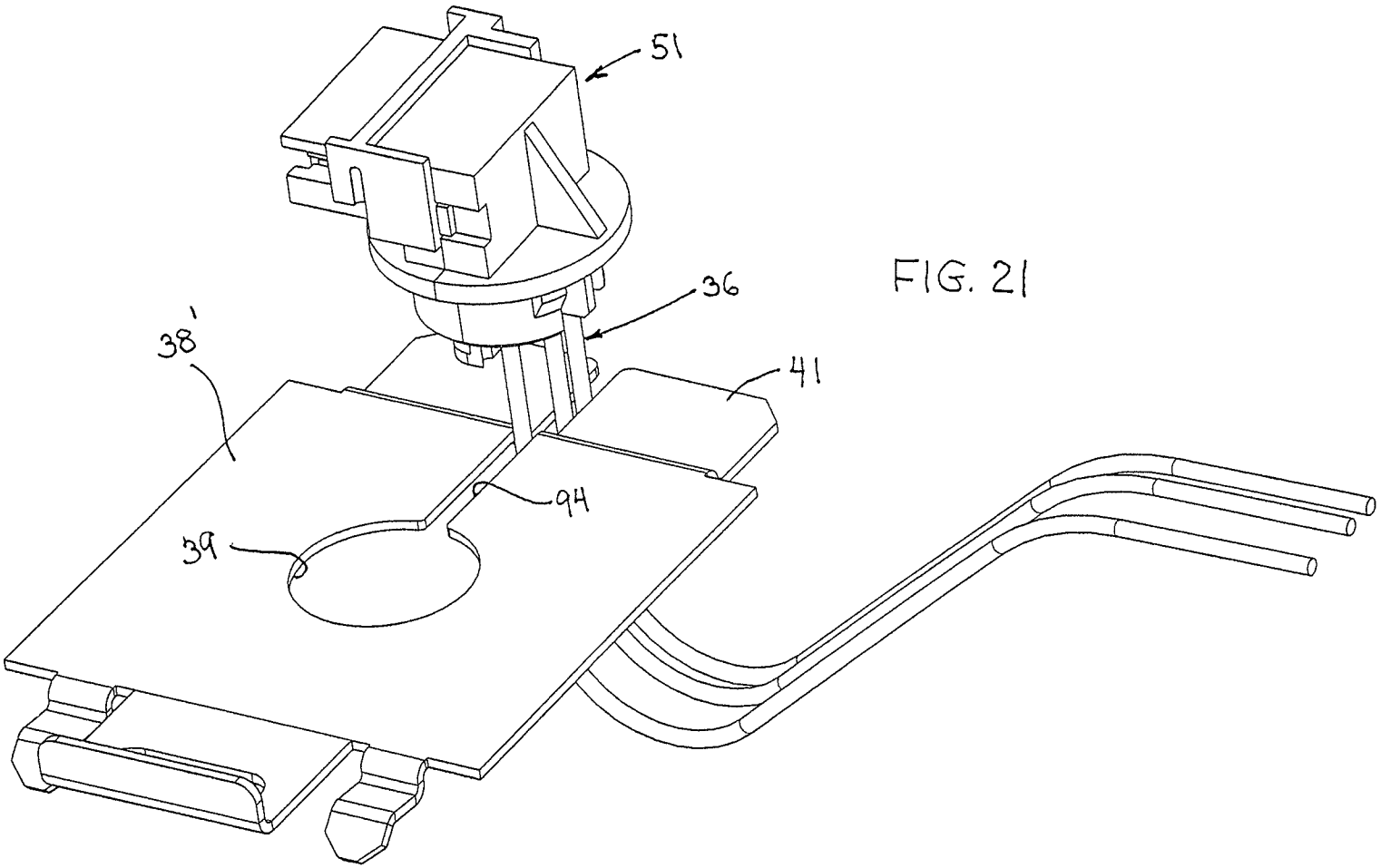
FIG. 21 is a perspective view which illustrates a modification with respect to the cover plate which can be provided on the housing of the light fixture.

Referring to FIG. 21, there is illustrated a modification of a cover plate 38' which mounts the electrical adapter 51 thereon. This modified cover plate 38' possesses all of the features associated with the cover plate 38 described above, but in addition has a clearance slot 94 formed therein and extending from the knockout port 39 to one of the side edges of the cover plate. This slot 94 is preferably sized so that the width thereof enables the pigtail conductors 36 to be moved therethrough, thereby enabling the pigtail conductors 36 to be assembled to the adapter 51 prior to the adapter being snap fitted into the port 39.

Figure 22:
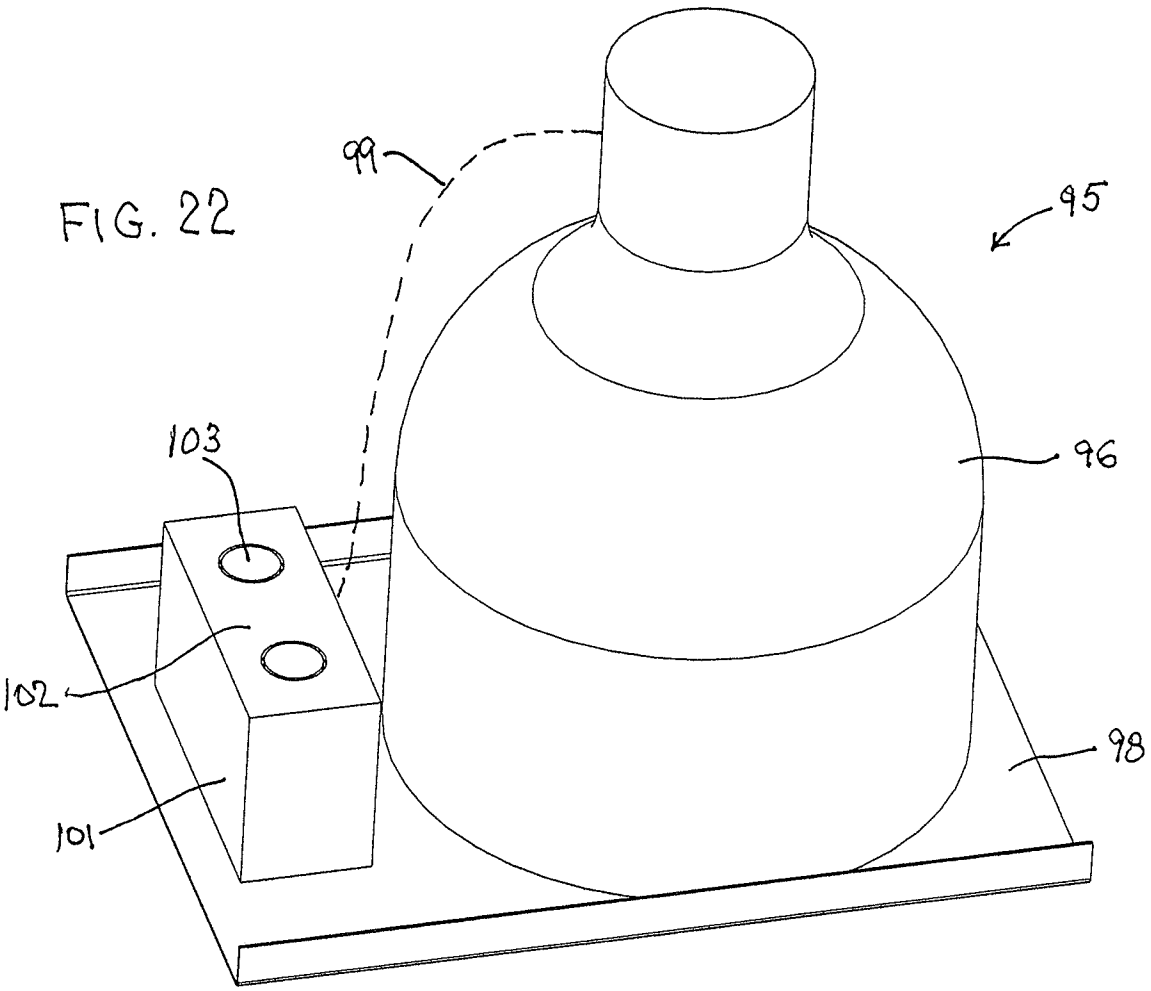
FIG. 22 is a perspective view of a different type of conventional ceiling light fixture which can be used with the adapter module of the present invention.
Figure 23:
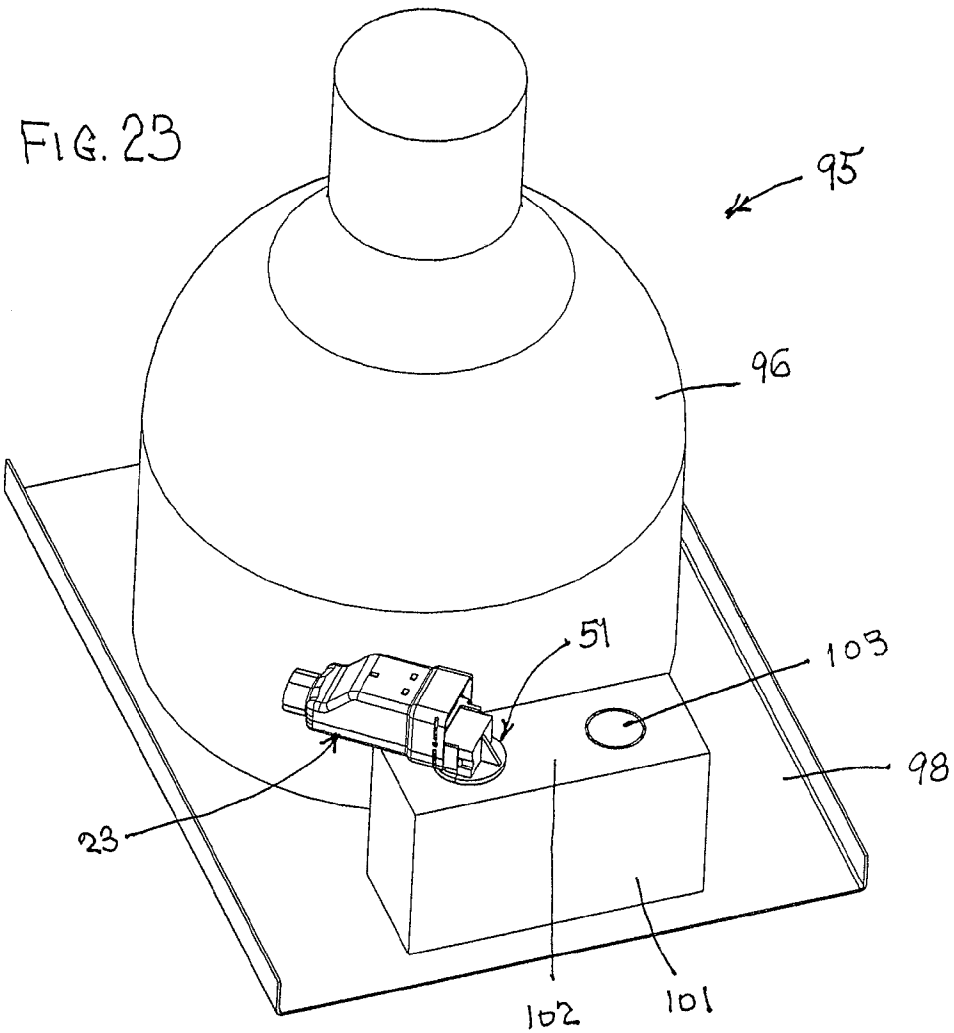
FIG. 23 is a perspective view of the light fixture shown in FIG. 22 and illustrating the adapter module connected thereto, the adapter module also being plugged into one end of a flexible modular electrical distribution unit.
Figure 24:
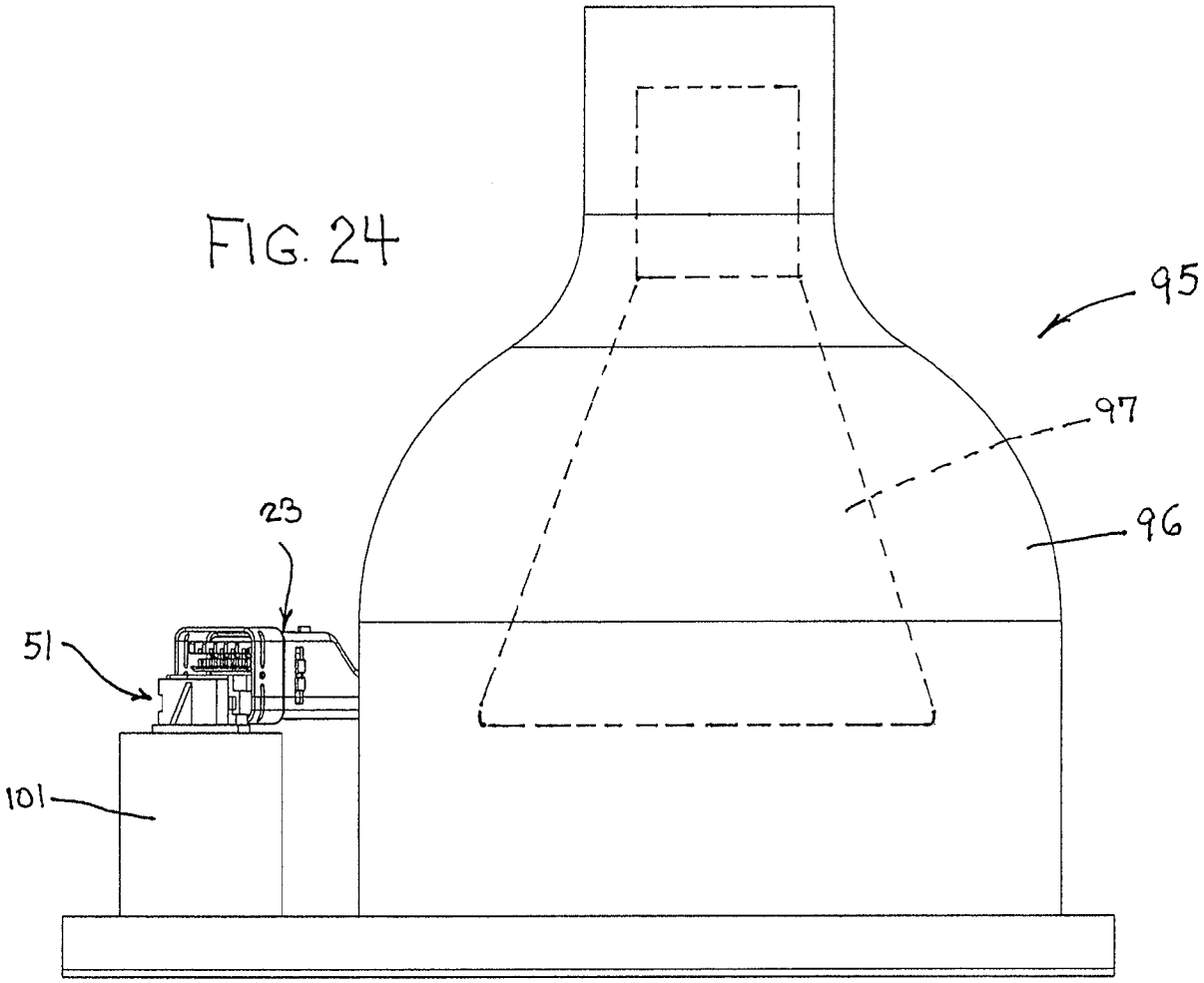
FIG. 24 is a side elevational view of the arrangement shown in FIG. 23.

Referencing now FIGS. 22-24, there is illustrated an alternate type of light fixture 95 which is in conventional use, and which resembles a can-type fixture having a bulb disposed therein. In this alternate light fixture 95, there is defined a surrounding can-shaped sleeve-like housing 96 which supports a conventional light bulb 97 therein. The housing 96 is supported on a suitable mounting plate 98, with the interior of the housing opening downwardly for illumination of an area disposed below the mounting plate 98. The light bulb is electrically energized by being mounted in a conventional electrically conductive support at the upper end of the housing, which in turn joins to one end of an electrical conduit 99, as indicated by dotted line in FIG. 22, and the other end of this conduit 99 typically projects into and terminates within a box-like housing 101 which is typically secured either to the plate 98 or to the side wall of the housing 96. The end of the electrical conduit 99 as disposed within the box 101 typically terminates in three exposed ended conductors similar to the conductors associated with the pigtail conductor 36 described above. The housing 101 is typically provided with a removable cover plate 102, and the housing typically has one or more knockout ports 103 associated therewith, at least one of the ports typically being in the removable cover plate 102. These knockout ports 103 are of conventional size, typically about ⅞ths inch diameter.

In accordance with the present invention, the cover plate 102 can be removed so as to access the exposed ends of the conductor 99 associated with the light fixture. In addition, the adapter 51 can be snap fitted onto the housing, such as by being snap fitted through the port 103 associated with the cover plate 102. The exposed conductive ends of the conductor wires associated with conduit 99 can be inserted into the output end of the adapter 51 to create electrical connection therewith, and the cover plate can then be secured to the housing 101. The connector 23 associated with the downstream end of a power distribution unit 21 can then be easily plugged into the input connector 58 (which corresponds to the connector 22) substantially as illustrated in FIG. 24, thereby electrically coupling the light fixture 95 to the building power system.

Referring now to FIGS. 25-35, there is illustrated an alternate adapter construction for connection to a light fixture, particularly a remote or difficult to-access light fixture such as a ceiling light fixture, to facilitate electrification thereof by connection to a modular electrical power distribution unit.

Figure 25:
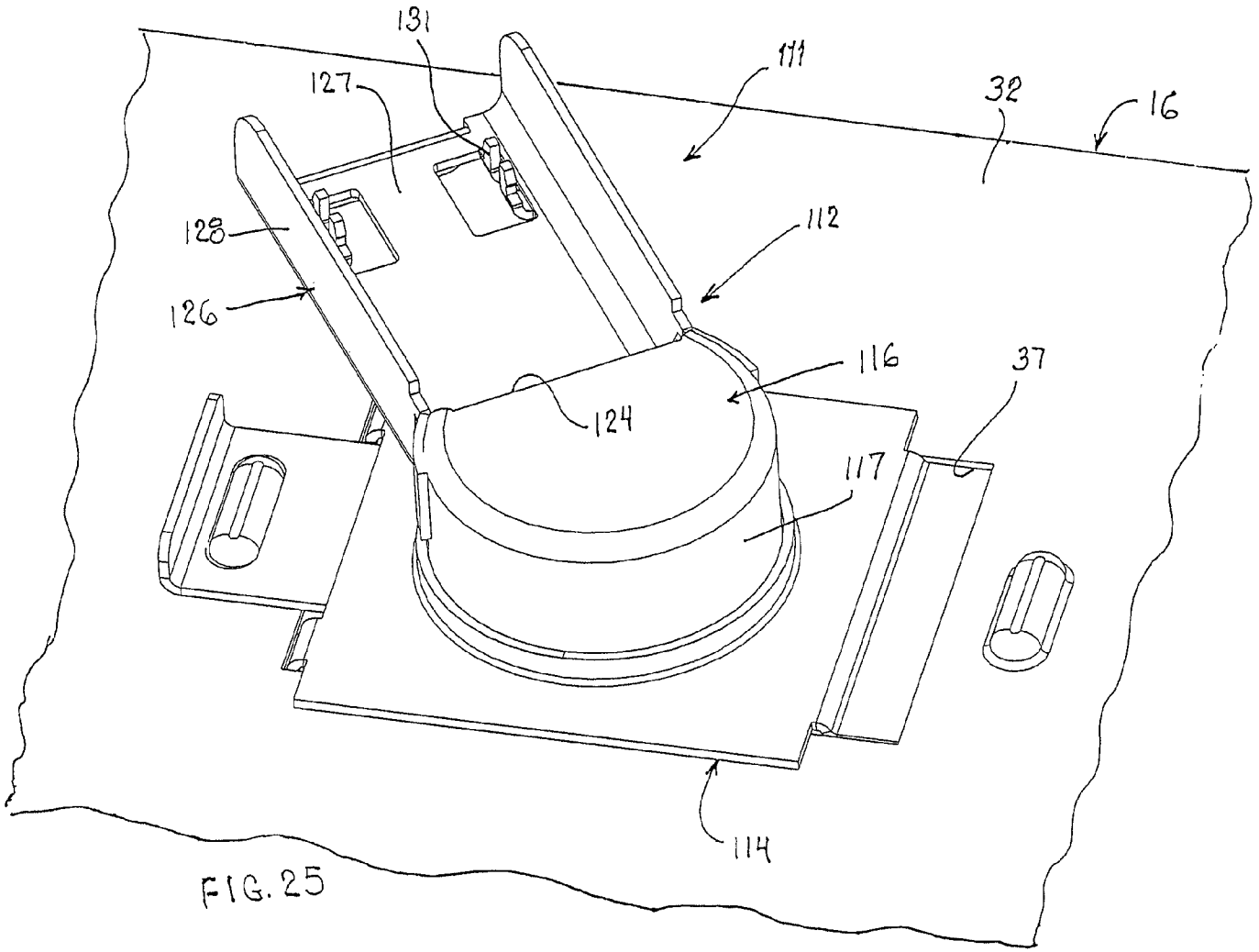
FIG. 25 is a perspective view, taken from above, of a second embodiment of a light fixture adapter according to the present invention, which adapter is illustrated mounted on a removable cover plate as associated with the light fixture housing.
Figure 26:
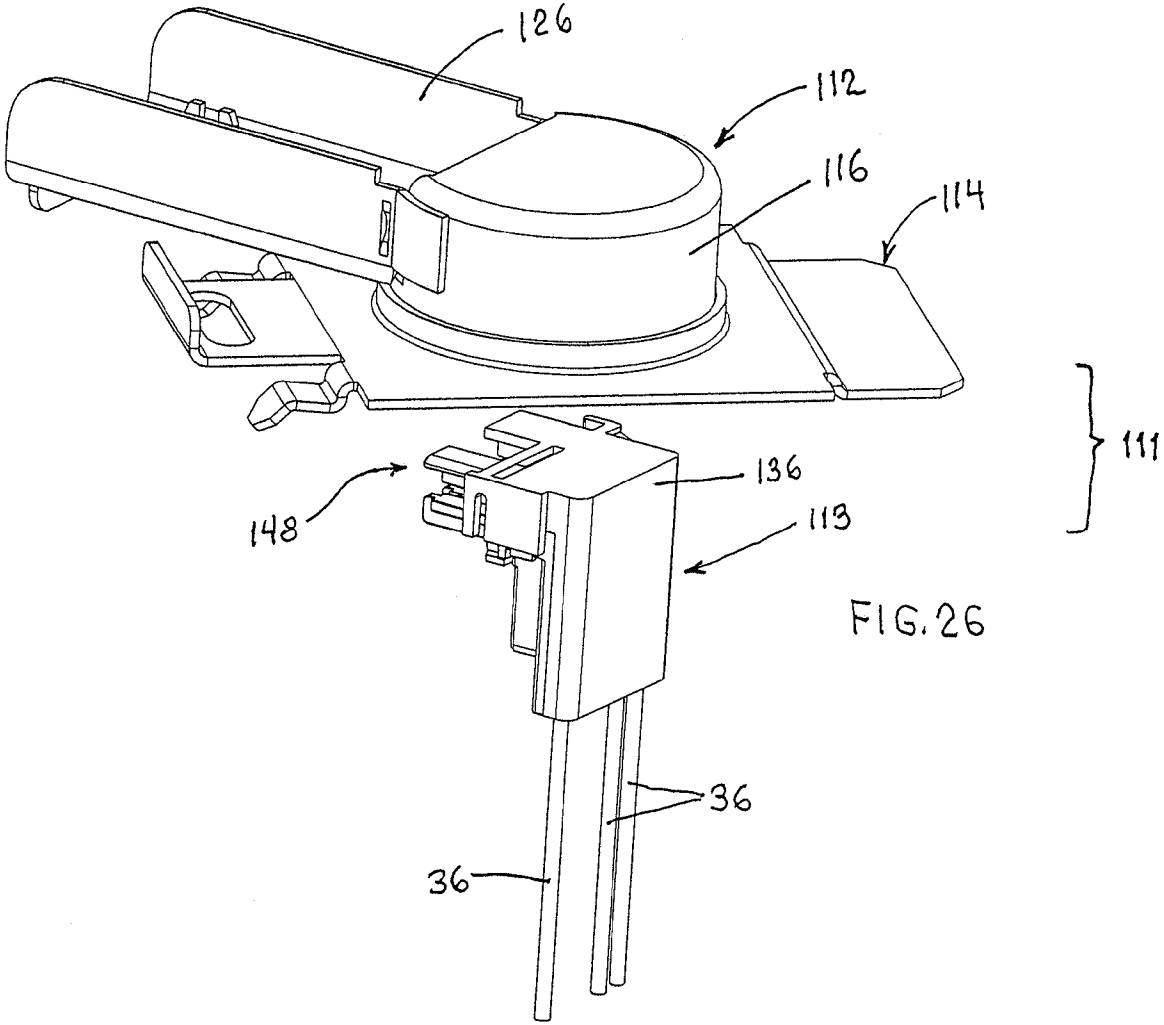
FIG. 26 is an exploded perspective view of the light fixture adapter shown in FIG. 25.

More specifically, as illustrated by FIGS. 25-26, the electrical fixture adapter 111 according to this alternate construction is primarily of a two-piece construction, in comparison to the modular one-piece structure defined by the above-described adapter 51. This alternate electrical fixture adapter 111 is defined primarily by an adapter housing 112 which couples to the light fixture housing, and an electrical connector 113 which is positioned within and extends through the adapter housing 112 for allowing plug-type electrical connection to a power distribution unit 21 at an upper or input end thereof, and to the light fixture pigtail conductors at a lower or output end thereof.

The adapter housing 112 includes a generally hat-shaped housing member 116 having a generally upright cylindrical side wall 117 closed off at the upper end by a top or end wall 118. The lower edge of the cylindrical side wall 117 has an annular flange 119 protruding radially outwardly thereof. The cylindrical side wall 117 also has a rather large window-like opening 124 formed therein, the latter extending through an annular extent of at least about 90° of the cylindrical side wall, and extending vertically downwardly from the top wall so as to terminate in a lower edge which is spaced upwardly a small distance above the bottom flange 119. The lower end of the cylindrical side wall 117 is open.

To accommodate connection of the hat-shaped housing member 116 to a cover plate 114 associated with a light fixture housing, which connection is preferably a rotatable one, the cover plate 114 has a large generally circular opening 121 (FIG. 30) extending therethrough. The cover plate is formed with an upstanding cylindrical flange which surrounds the opening 121 and projects upwardly through a small vertical extent, terminating at an upper edge 123 which may be formed as an annular bead or rim. The associated opening 121 and associated flange 122 are sized to permit the cylindrical side wall 117 of the hat-shaped housing member 116 to be inserted upwardly through the opening 121, with the flange 119 abutting the underside of the cover member 114. The rim or bead 123 may create a snug but relatively rotatable contact with the cylindrical side wall 117 of the hat-shaped housing member.

The cover member 114, other than the provision of the large access opening 121 formed therethrough, can otherwise be of conventional construction, and in fact can be otherwise formed so as to include all of the same structural and functional features as the cover plate 38 described above so as to permit cooperation with the access opening 37 formed in the top wall 32 of the light fixture 16.

Figure 31:
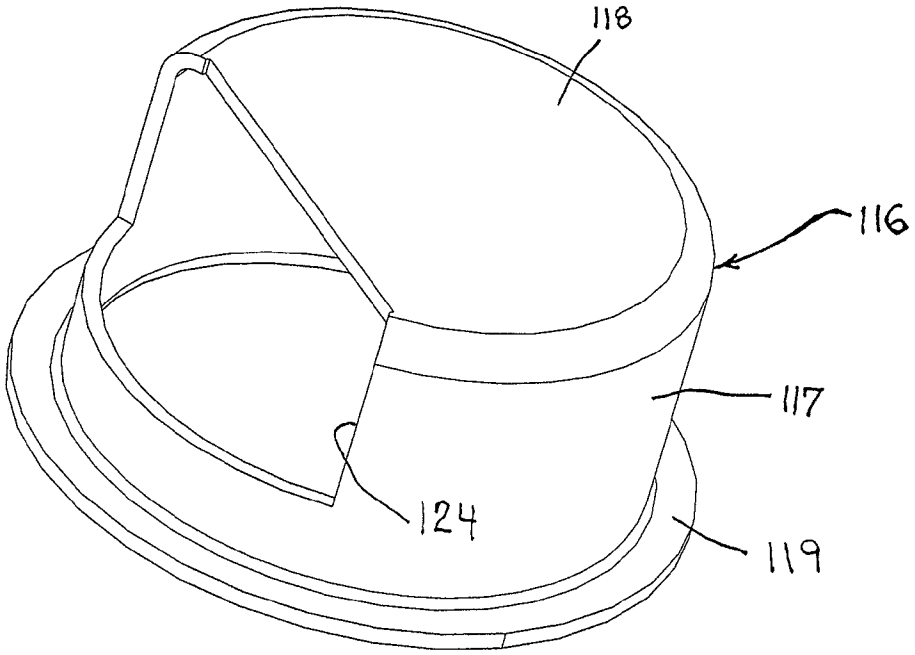
FIG. 31 is a perspective view of a hat-shaped housing member which forms part of the adapter housing.
Figure 32:
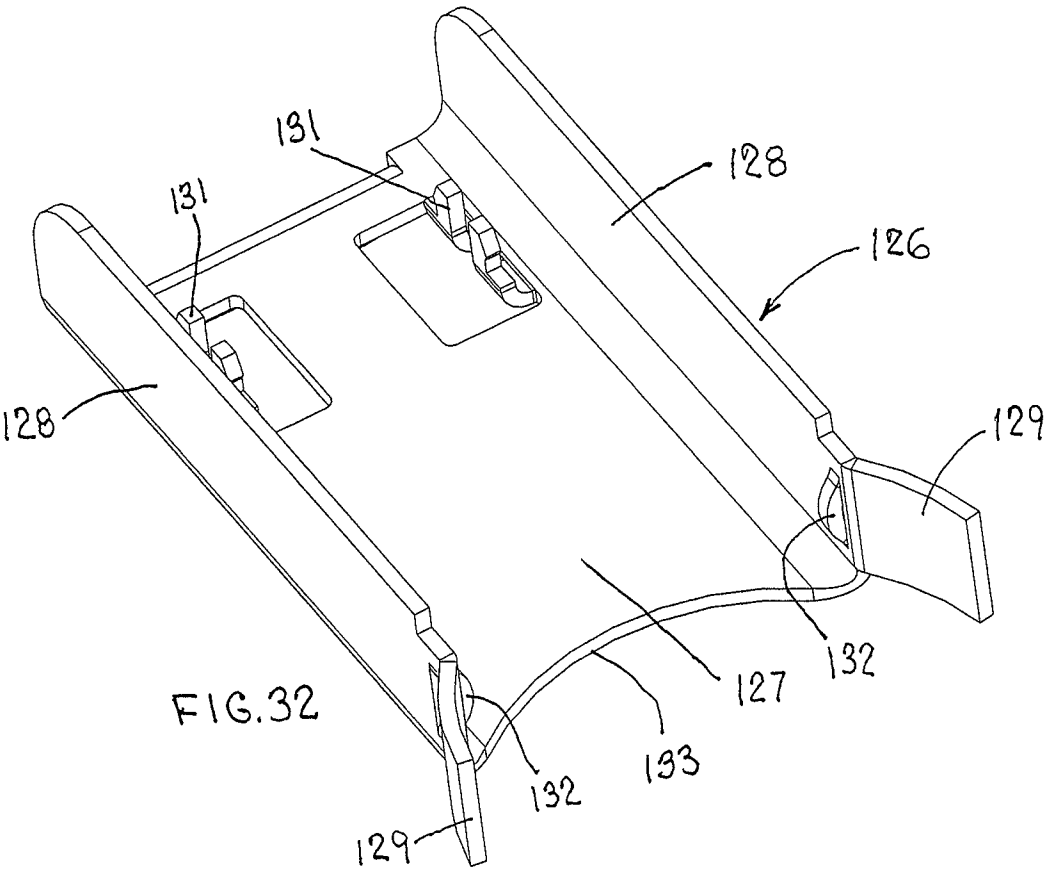
FIG. 32 is a perspective view of a support tray which secures to the hat-shaped housing member of FIG. 31.

The adapter housing 112 also includes a support member or tray 126 which is fixed to and protrudes radially outwardly from the hat-shaped housing member 116 generally in alignment with the window 124. The support tray 126, as illustrated in FIG. 31, is elongated generally horizontally so as to project radially outwardly from the hat-shaped housing member, and in transverse cross section has a generally upwardly-opening channel-shaped configuration. This channel-shaped configuration of the support tray 126 is defined by a generally flat bottom wall 127 which is oriented generally horizontally and, at opposite side edges, joins to a pair of generally parallel side flanges 128 which are upwardly cantilevered. The inner ends of the side flanges 128 are joined to mounting flanges 129 which are cantilevered inwardly, and which are curvingly flared outwardly so that the two sidewardly-spaced mounting flanges 129 effectively have inner surfaces disposed on a radius which conforms to the exterior diameter of the housing member sleeve 117, whereby these mounting flanges 129 contact the exterior surface of the cylindrical housing sleeve 117 directly adjacent opposite sides of the window 124, and are fixed thereto, such as by welding or other suitable securing means.

The flat bottom wall 127 of the support tray 126 has the inner end edge 133 thereof formed with a concave curvilinear shape defined on a radius which also conforms to the exterior configuration of the cylindrical sleeve 117, whereby the inner end edge 133 effectively abuts the sleeve 117 generally along the bottom edge of the window 124. This enables the interior channel defined by the support tray 126 to be in open communication with the interior of the hat-shaped housing member 116 through the window 124.

The support tray 126 is also preferably provided with structure for creating a latching engagement with an end connector, such as the end connector 23 associated with a flexible electrical distribution unit 21. For this purpose, the bottom wall 127 adjacent the outer end thereof is provided with resilient latching fingers 131 protruding upwardly therefrom adjacent opposite sides thereof. These latching fingers 131 cooperate with latch-receiving recesses formed in the end connector 23, as described in the copending earlier applications as cross referenced herein. The support tray 126 also has, adjacent the forward ends of the side walls 128, securing tabs 132 which are cantilevered inwardly from the respective side walls 128 generally toward one another in close proximity to the forward free ends of the side walls. These securing tabs 132 cooperate with recesses associated with the side walls of the end connector 23 in a manner described in the aforementioned copending applications, whereby they facilitate proper but restrained positioning of the end connector 23 within the support tray 126.

Figure 27:
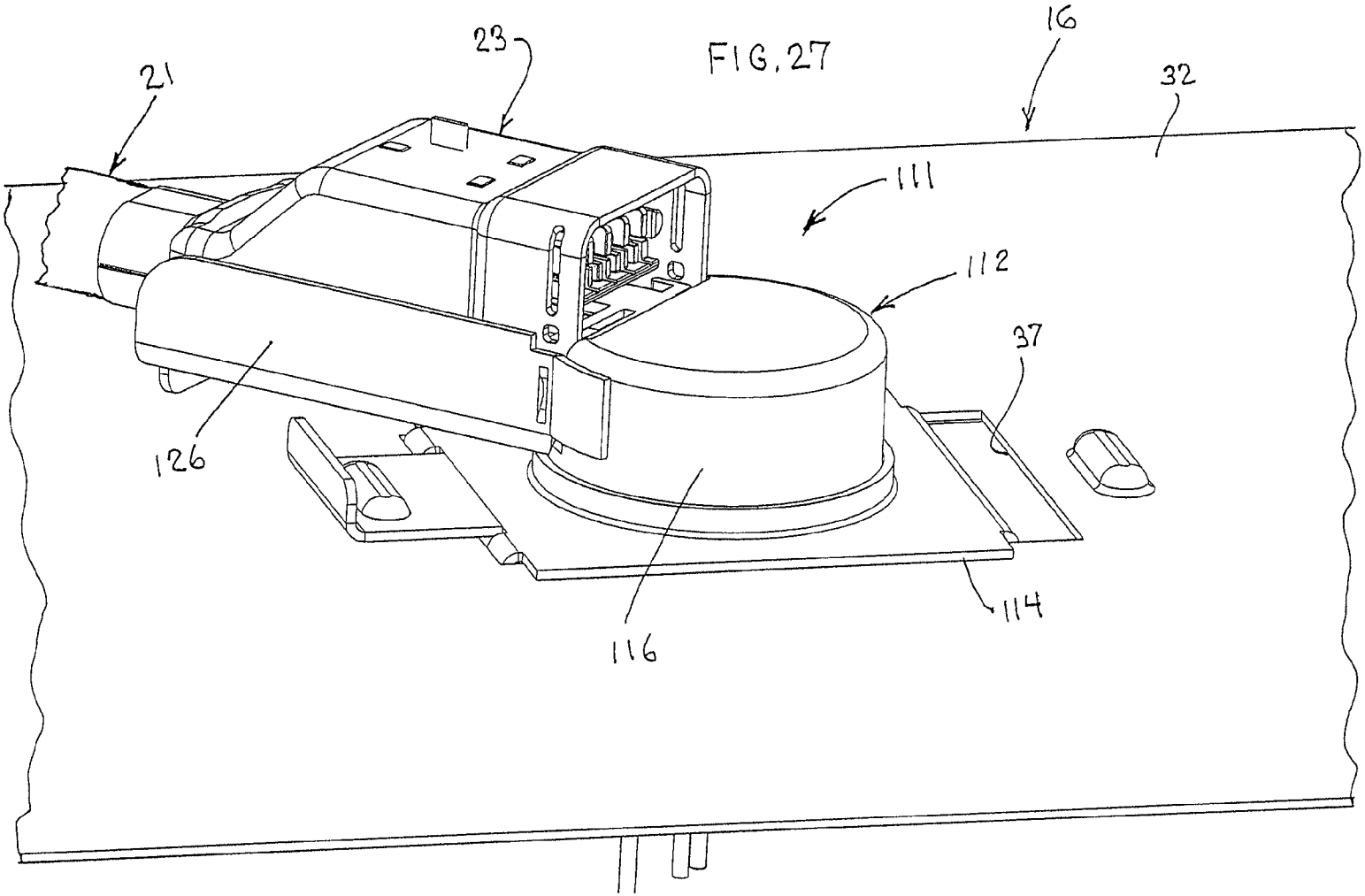
FIG. 27 is a perspective view similar to FIG. 25 but illustrating the end connector associated with the power distribution unit connected to the light fixture adapter.

When the adapter housing 112 is mounted on the cover member 114 in the manner described above, and the cover member in turn is secured to the top wall 32 of the light fixture 16, the adapter housing 112 can be rotated generally in the plane of the top wall so that the window 124 and the associated support panel 126 can be oriented at any desired angular angle relative to the light fixture so as to more readily accommodate the in-feed direction of the power distribution unit 21 being connected thereto. This greatly facilitates positioning and securement of the end connector 23 to the support tray 126, as illustrated in FIG. 27, in which illustration the end connector 23 is a double connector having two B type electrical connectors associated therewith, the upper one permitting connection to a still further downstream power distribution unit 21.

Figure 34:
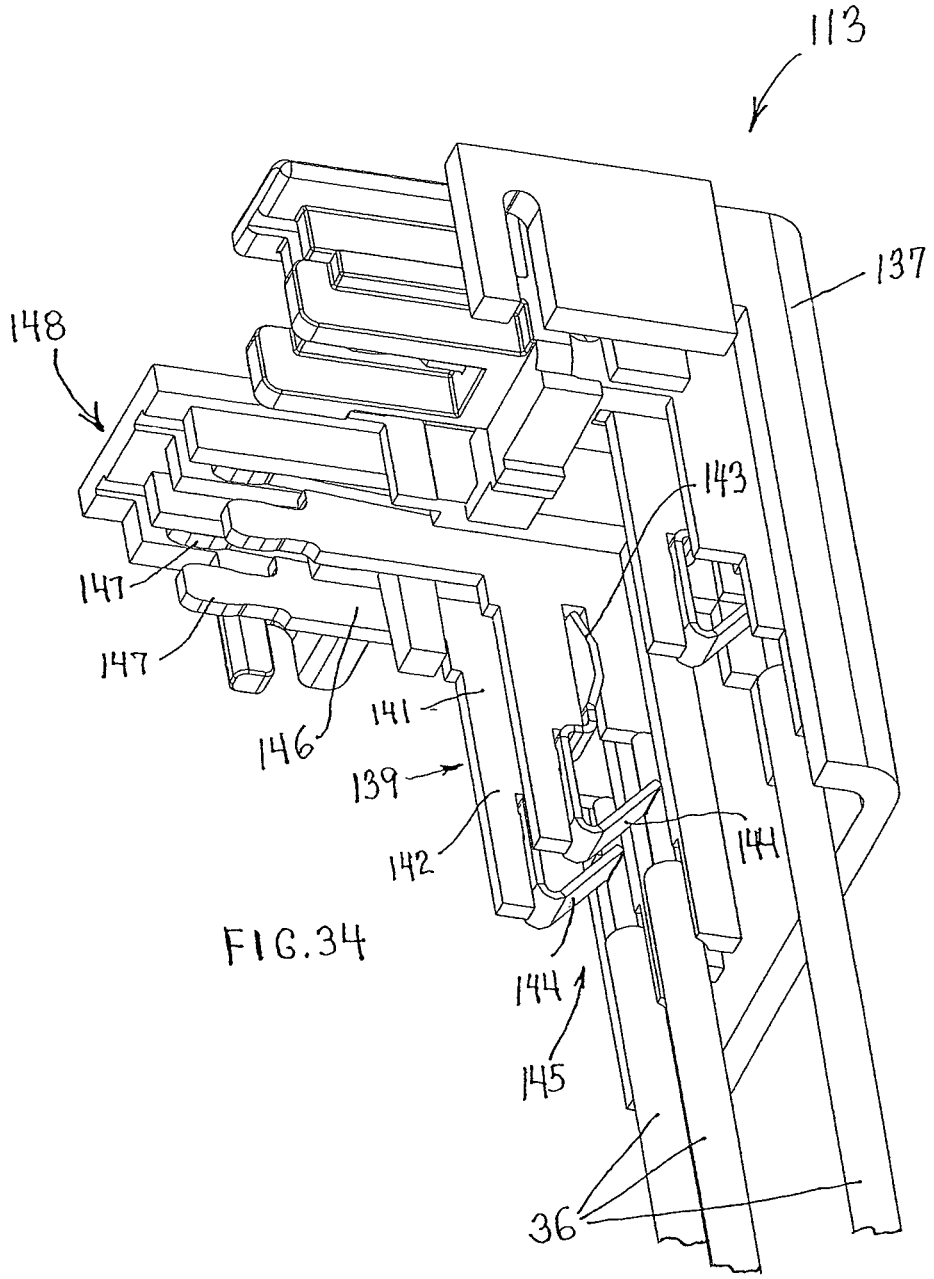
FIG. 34 is an enlarged perspective view similar to FIG. 33 but illustrating one side of the housing removed for illustrating the interior conductors.
Figure 35:
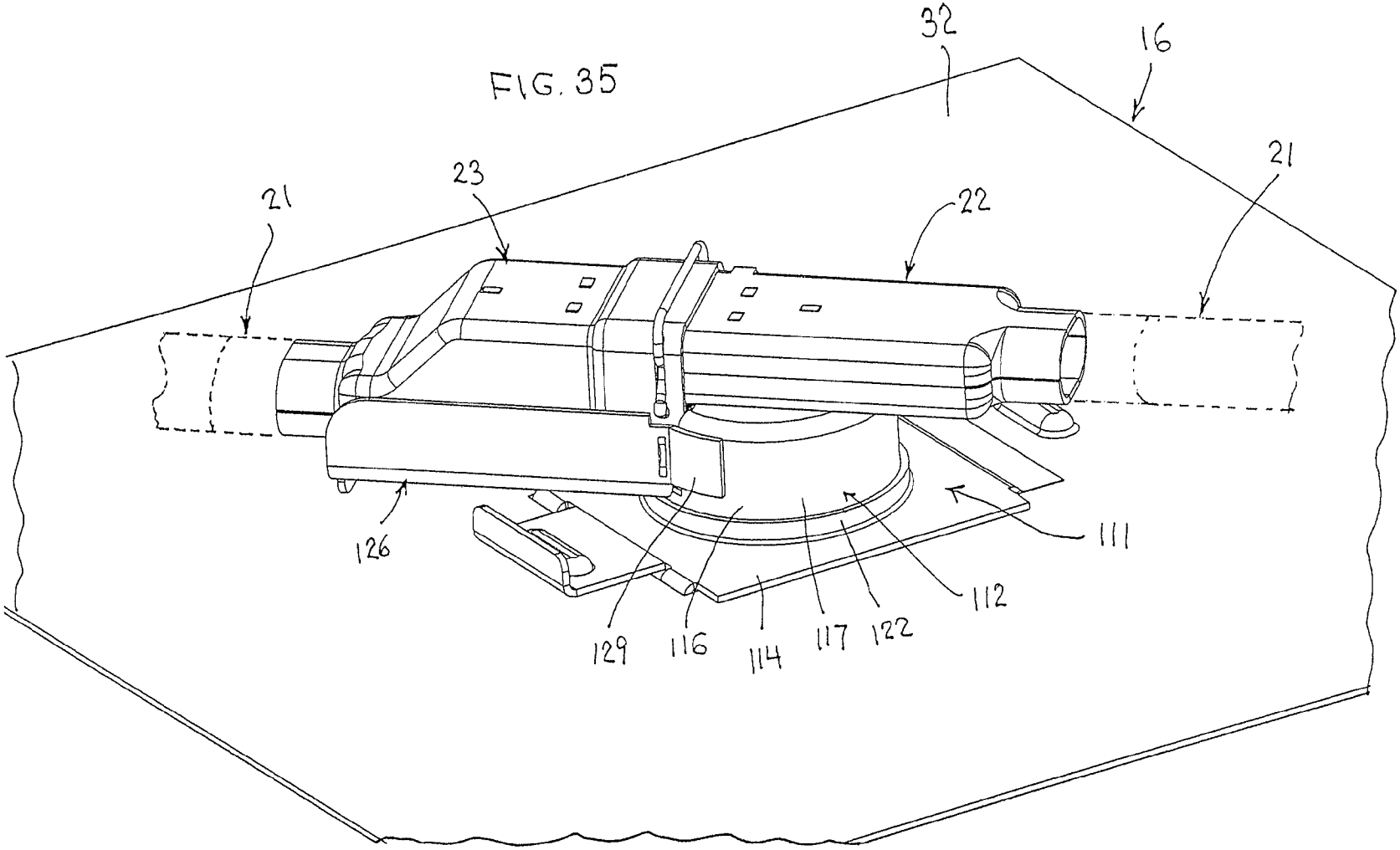
FIG. 35 is a perspective view similar to FIG. 27 illustrating connection of the power distribution unit to the adapter, while additionally illustrating the input end of the further power distribution unit coupled thereto to permit ganging of adjacent light fixtures.

Considering now the electrical connector 113 and referencing specifically FIGS. 34 and 35, this electrical connector 113 is a generally 90° or right angle connector which defines thereon a plug-type electrical connector 148 at the upper or input end thereof, and a socket-type gripping electrical connector 145 at the lower or output end thereof. These connectors face in transverse direction, the upper connector 148 facing sidewardly, and the socket connector 149 facing downwardly, thereby providing a 90° configuration to the overall connector 113.

The plug-type electrical connector 148 is similar in structure with respect to its electrical contacts and supportive insulative housing to the A type plug connector defined at the input end connector 22 of the power distribution unit 21, as previously discussed, and the socket-type connector 145 defined at the lower output end is similar to the socket connector 63 defined at the output end of the previously described electrical adapter module 51.

Figure 33:
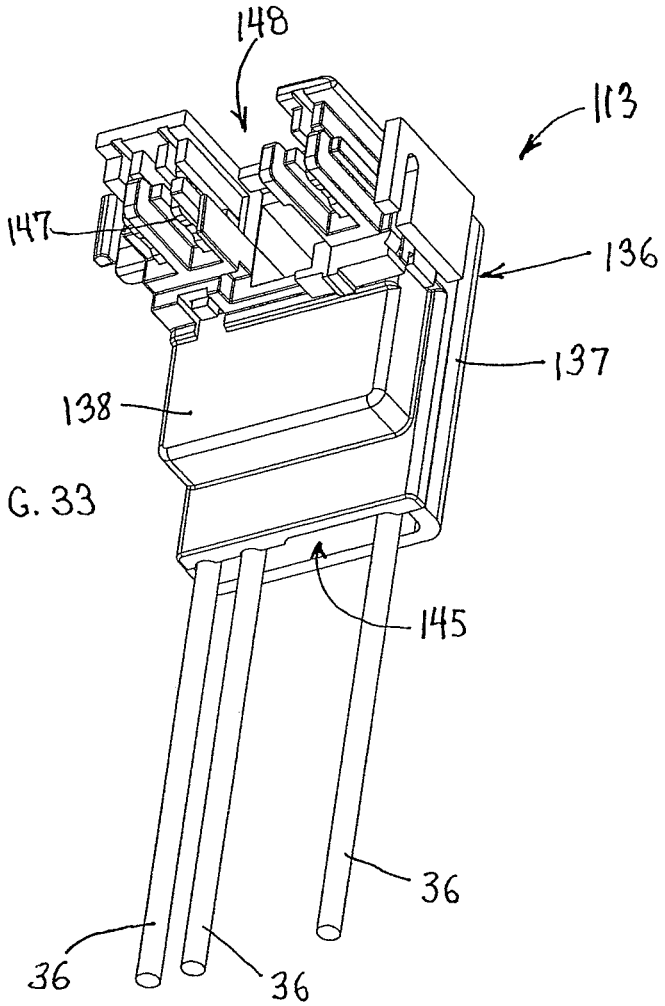
FIG. 33 is a perspective view of a 90° electrical connector which forms part of this embodiment of the adapter.

The construction of the electrical connector 113, however, is described in somewhat greater detail hereinafter with reference specifically to FIGS. 33 and 34.

The 90° electrical connector 113 includes a housing 136 of electrically insulative material, which housing is defined primarily by front and rear housing parts 137 and 138, respectively, which cooperate to support therein a plurality of generally parallel electrical conductors 139, there being three such connectors in the illustrated arrangement so as to permit connection to the respective live, neutral and ground pigtail conductors 36 associated with the light fixture. Each of the conductors 139 is constructed generally similar to the conductors 53 associated with the adapter module 51 in that it includes a first conductor member 141 defined by a generally L-shaped conductive plate, a lower leg 142 of which projects vertically downwardly and is suitably slotted so as to be disposed in gripping and electrically conductive engagement with a second conductive member 143, the latter at its lower end terminating in a deflectable cantilevered leg 144 which at its tip end is positioned adjacent and slightly spaced from a conductive contact surface on the lower leg 142. The deflectable cantilevered leg 144, and its cooperation with an opposed surface on the lower leg 142, creates a gripping type electrical socket 145 which enables the protruding end of the wire associated with the pigtail conductor 36 to be slidably inserted into grippingly engaged between the cantilevered leg 144 and the lower leg 142 in the same manner as illustrated and described relative to the adapter module 51. In this fashion, the plurality of conductive plates 141 and their cooperation with the respective second conductive members 143 hence define three sidewardly-spaced grip sockets 145 for creating electrical engagement with the three conductors 36 which are associated with the pigtail of the lighting fixture, such as the pigtail which protrudes from the ballast of a fluorescent light fixture.

Each conductor 139 also has an upper leg 146 associated with the respective L-shaped conductive 142, which upper leg protrudes horizontally toward the side input of the 90° connector 113 and terminates in a pair of horizontally protruding contacts which are spaced apart by an intermediate slit or slot. The split contacts 147 associated with each of the conductors 139, and the cooperating support and guides defined by the insulative housing, hence define a plug-type electrical connector 148 which is of the A type, and which is accessible sidewardly from the upper end of the 90° connector 113. This A type electrical connector 148, which is identical to the electrical connector associated with the connector 22 of the power distribution unit 21, can hence be readily plug-engaged with the B type electrical connector provided on the output end connector 23 of the power distribution unit 21. The A-type connector 148 is preferably a circuit-selectable connector wherein the live contact is slidable into one of three possible positions for cooperation with a five-wire infeed system, as disclosed in the aforementioned patents.

With the alternate construction illustrated by FIGS. 25-35, the housing arrangement 112 can be assembled to the cover plate 114 when the latter is disconnected from the top wall 32. The housing arrangement 112 can be rotated relative to the top wall 112 so as to orient it in the desired direction. The output end of the power distribution unit 21 is connected to the housing unit 112 by positioning the end connector 23 within the support tray 126. The front or free end of the end connector is first inserted downwardly into the tray 126 so that the free end of the end connector protrudes into the window-like opening 124, and the securing tabs 132 project into slots formed on opposite sides of the end connector 23 housing, thereby restraining the end connector in the lengthwise direction of the support tray 126. Further downward displacement of the rear end of the end connector 23 causes the latch fingers 131 to protrude upwardly into the bottom recesses formed in the end connector 23 and effect latching engagement therewith, thereby fixedly securing the end connector 23 to the housing arrangement 112.

Figure 28:
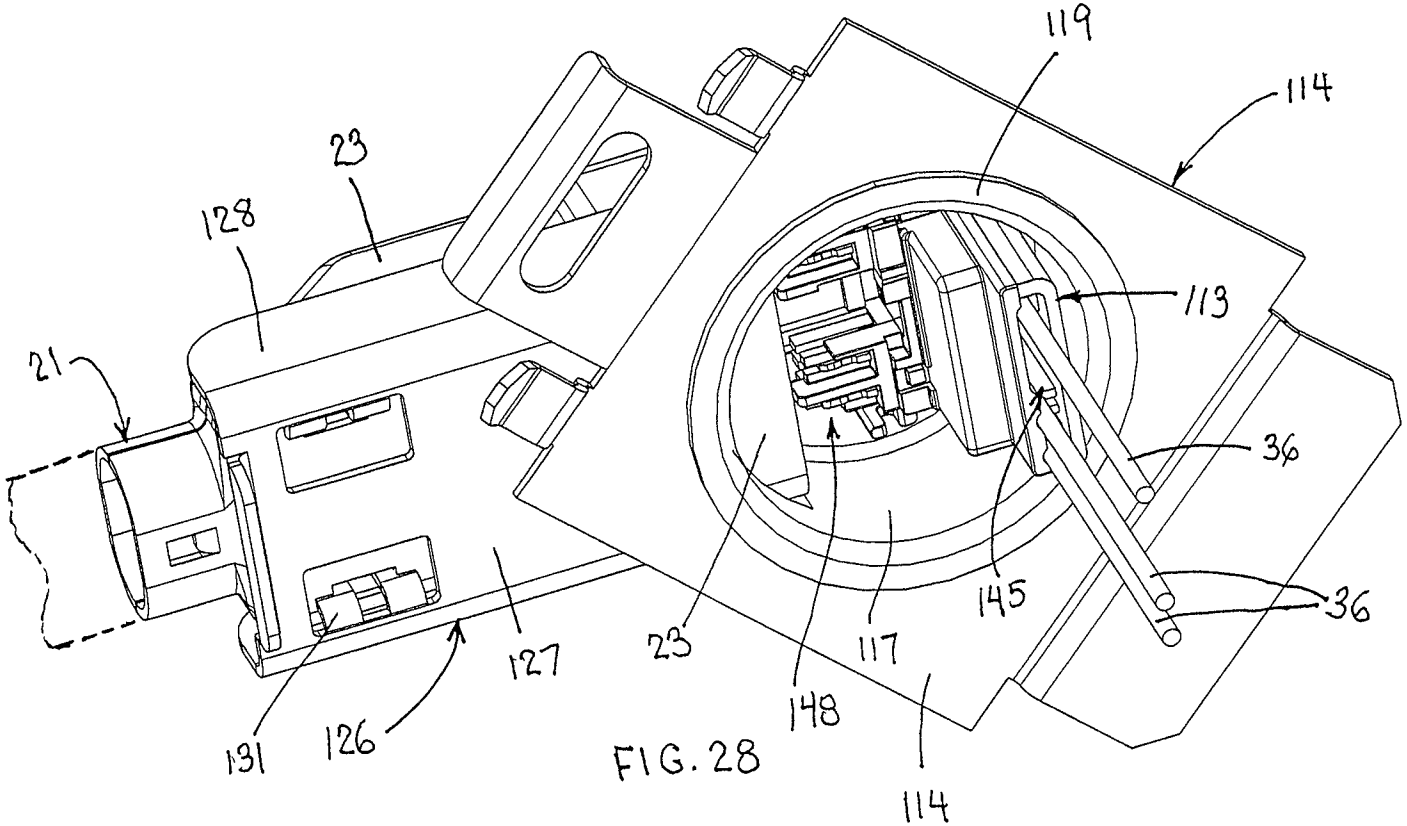
FIG. 28 is a perspective view, taken generally from below, showing the adapter housing secured to the removable cover plate, and additionally showing insertion of an electrical connector upwardly into the adapter housing, prior to the connector being plug-engaged with the end connector of the power distribution unit.
Figure 29:
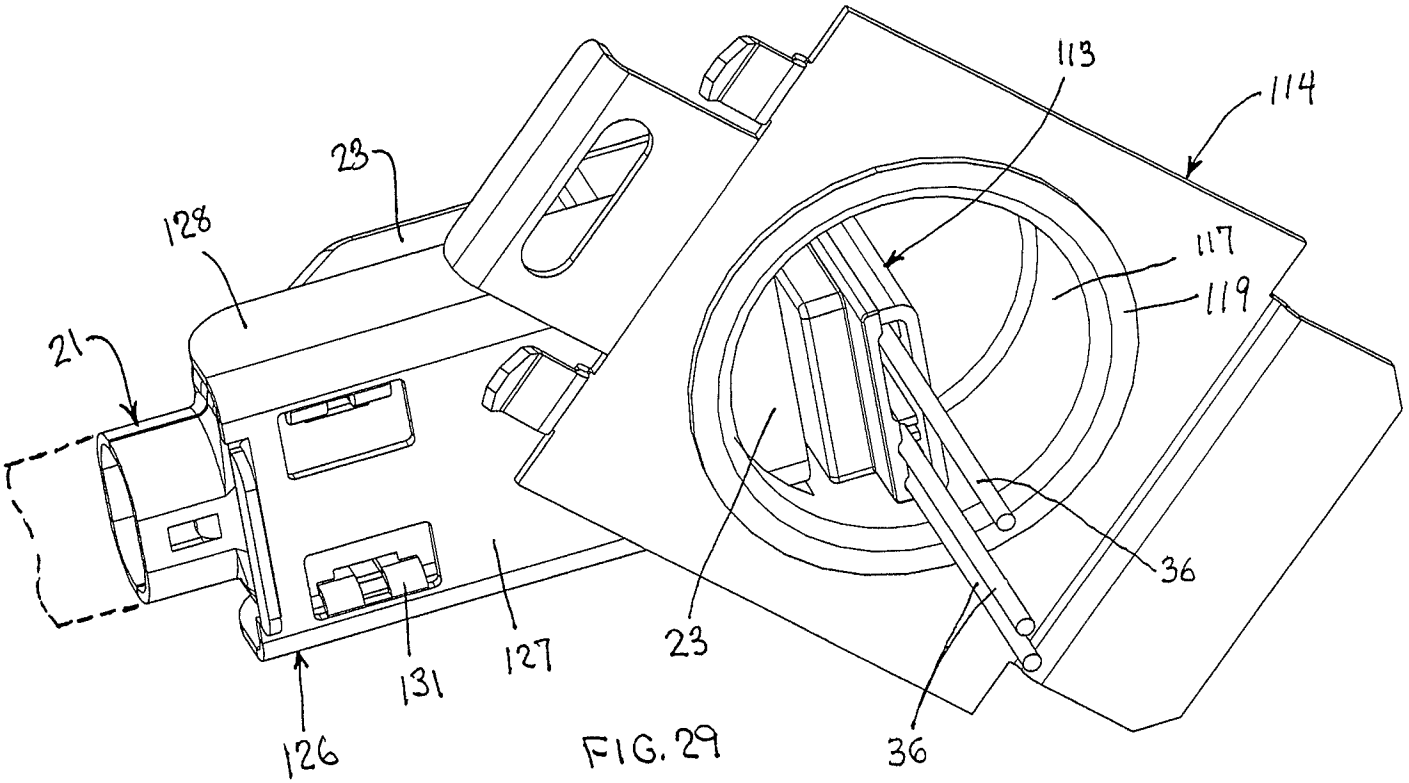
FIG. 29 is a perspective view corresponding to FIG. 28 but illustrating the electrical connector plug-engaged with the end connector of the power distribution unit.
Figure 30:
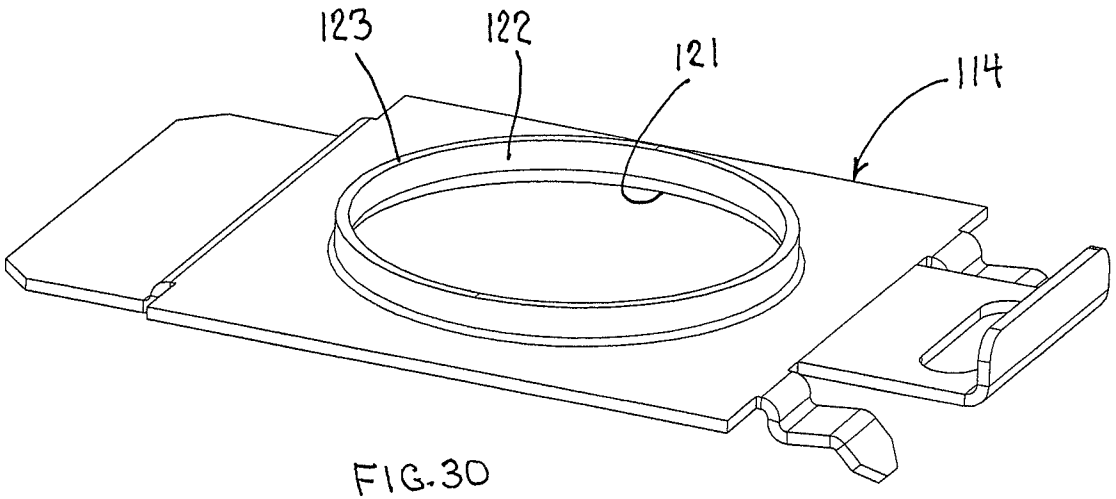
FIG. 30 is a perspective view of solely the cover plate for the light fixture, which cover plate is configured for cooperation with the light fixture adapter of FIG. 25.

The 90° electrical connector 113 is connected to the pigtail conductor 36 associated with the light fixture by individually sliding the bare wire end of each connector 36 into the appropriate gripping socket 145 so as to create the gripping and electrical contacting engagement substantially as illustrated by FIG. 34. The 90° connector 113, which is now joined to the light fixture through the pigtail conductors 36 which extend upwardly through the access opening 37, is then inserted upwardly into the interior of the hat-shaped housing 112 so that the plug type connector 148 is generally aligned with the B type connector which is accessible through the window 124, as illustrated in FIG. 28. The operator then manually displaces the 90° connector 113 (leftwardly in FIG. 28) so that the plug-in connector 148 is inserted into the B type connector associated with the adjacent end of the end connector 23, thereby creating an electrical and mechanical connection of the 90° connector 113 to the end connector 23, substantially as illustrated in FIG. 29. With the light fixture now electrically and mechanically coupled through the 90° connector 113 to the end connector 23, the cover plate 114 can be repositioned over the access opening 37 and engaged with the top wall 132 so as to secure the overall arrangement to the housing of the light fixture.

While the plug-type electrical connectors described herein, specifically the A and B type connectors associated with the power distribution unit 21 and the electrical fixture adapters 51 and 111, are structurally and functionally identical to the connectors illustrated and described in the aforementioned copending applications, and as such are preferred constructions for the electrical connectors, it will nevertheless be apparent that other configurations of the electrical plug type connectors can also be adapted to and used in conjunction with the fixture adapters of the present invention, provided that such electrical connectors need all appropriate safety, electrical and building codes.

Although a particular preferred embodiment of the invention has been disclosed in detail for illustrative purposes, it will be recognized that variations or modifications of the disclosed apparatus, including the rearrangement of parts, lie within the scope of the present invention.

I claim:

1. A ceiling-type fluorescent light fixture, comprising:

a housing defining a downward-opening chamber for accommodating a fluorescent light bulb therein;

the housing including a top wall having an access opening therethrough, and a cover plate removably mounted on said top wall for substantially closing said access opening, said cover plate having a knock-out port formed therethrough;

a ballast mounted on said housing and positioned within said chamber, said ballast having a flexible multi-conductor pigtail electrical connector projecting therefrom;

an electrical adapter module mounted on said cover plate and projecting through said port, said adapter module having an input end disposed above the cover plate and an output end disposed below the cover plate and positioned generally within said chamber when the cover plate is mounted on said housing;

said module defining at the output end thereof a gripping-type multi-contact electrical socket for accommodating and creating electrical contacting engagement with electrical conductors associated with the pigtail connector, said socket being oriented in a lengthwise direction of said module and accessible from said output end thereof;

said module at the input end thereof defining a shielded plug-type connector for electrical connection to a compatible power supply connector, said plug-type connector being oriented transverse to the lengthwise direction of the module and accessible sidewardly at the input end thereof.

2. A light fixture according to claim 1, wherein said adapter module includes a housing of electrically non-conductive material, and a plurality of generally parallel electrical conductors supported within said housing and extending between and defining electrical contacts associated with the multi-contact electrical socket and the shielded plug-type connector; and said housing, in the vicinity of said output end, having a sleeve-like body insertable through and snuggly fitted within said port;

said sleeve-like body having resilient latch arrangement for insertion through the port and engagement with a bottom side of the cover plate for retaining adapter module thereon.

3. A light fixture according to claim 2, wherein the knock-out port has a diameter of about 1 inch or less.

4. A lighting fixture according to claim 2, wherein the adapter module has a release member slidably supported on said housing and manually accessible from said output end, said release member being manually slidable inwardly of the housing to effect release of the pigtail conductor from said gripping-type socket.

5. A light fixture according to claim 4, wherein each conductor, at an output end thereof defining the gripping-type socket, includes first and second electrical opposed contacts defining a narrow gap therebetween for accommodating a pigtail conductor in contacting engagement therebetween, one of said opposed electrical contacts being resiliently displaceable, and said release member when in said inner position contacting and resiliently deflecting said one contact away from the other opposed contact.

6. In a lighting fixture having a housing structure provided with a knock-out port associated with a wall thereof for communication between interior and exterior regions, a multi-conductor pigtail electrical cable connected to the light fixture, the pigtail electrical cable having a free terminal end normally disposed in said interior region, the improvement comprising:

an electrical adapter module mounted in and projecting through said port and secured to said wall to prevent separation therefrom;

said adapter module being longitudinally elongated and defining input and output ends which are respectively disposed in said exterior and interior regions;

said adapter module including a housing of electrically non-conductive material and a plurality of electrical conductors supported within said housing in electrically parallel relationship, said housing and said conductors cooperating to define a shielded plug-type electrical connector which opens sidewardly on the input end of said housing; and said housing and said conductors cooperating to define a gripping-type multi-conductor electrical socket arrangement which opens lengthwise of said housing at the output end thereof, said socket arrangement receiving therein conductors associated with the pigtail cable.

7. A light fixture according to claim 6, wherein the housing of said adapter module includes a resilient latch which cooperates with an edge of said knock-out port for securing said adapter module to said wall.

8. A light fixture according to claim 6, wherein said knock-out port has a maximum diameter of about 1 inch, and said housing adjacent said output end has an outer peripheral profile which generally conforms to said port and can be passed therethrough to permit mounting of the adapter module on the wall, said housing having a resilient latch which is resiliently deflectable transversely inwardly to permit passage of the adapter module through the port, said latch resiliently moving outwardly after passing through the port to overlap the wall and prevent withdrawal of the adapter module from the port.

9. A light fixture according to claim 8, wherein the adapter module includes a release member slidably mounted on the housing adjacent the output end thereof and manually slidable into a release position for effecting release of the pigtail conductors from the socket arrangement.

10. A light fixture according to claim 9, wherein the release member is slidably supported on the housing for movement generally parallel to the lengthwise direction thereof.

11. In an electrical system for a building including a plurality of elongate power distribution units serially connected for supplying electrical power therethrough, said units including dissimilar but compatible first and second shielded plug-engagement connectors at respective input and output ends thereof so that the second connector on one said unit has a plug-engagement with the first connector of a serially joined said unit, and a plurality of ceiling light fixtures electrically joined to said system, the improvement comprising:

an electrical fixture adapter mountable on a wall of one of the ceiling light fixtures, said fixture adapter having a housing which mounts on the wall and cooperates with and projects at least partially through an opening therein;

said housing having input and output ends which are respectively accessible from opposite sides of said wall;

said fixture adapter having electrical conductive structure extending through said housing between the input and output ends thereof, said electrical conductive structure at said input end defining a plug-engagement electrical connector which is engageable with a said second connector associated with one of said power distribution units, and said electrical conductive structure at said output end defining a gripping-type multi-conductor electrical socket which is directly engageable with pigtail conductors which connect to and form a part of the ceiling light fixture.

12. A system according to claim 11, wherein the housing of the fixture adapter is of an electrically insulative material and supports the electrical conductive structure therein and defines a one-piece module which seats directly within the opening through said wall.

13. In an electrical system according to claim 11, wherein the housing mounts on the wall and defines a passage therethrough which provides communication with regions located on opposite sides of said wall, and said electrical conductive structure is defined by a separate connector structure which is positioned within and extends through said passage and defines said plug-engagement electrical connector and said electrical socket at opposite ends thereof.

* * * * *